US011622660B2

(12) United States Patent
Yang et al.

(10) Patent No.: US 11,622,660 B2
(45) Date of Patent: Apr. 11, 2023

(54) CLEANER

(71) Applicant: LG ELECTRONICS INC., Seoul (KR)

(72) Inventors: In Gyu Yang, Seoul (KR); Jin Hyouk Shin, Seoul (KR); Kyoung Ho Ryou, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/112,787

(22) Filed: Dec. 4, 2020

(65) Prior Publication Data

US 2021/0186285 A1 Jun. 24, 2021

(30) Foreign Application Priority Data

Dec. 20, 2019 (KR) ..... 10-2019-0172519

(51) Int. Cl.
*A47L 9/10* (2006.01)
*A47L 5/24* (2006.01)
(Continued)

(52) U.S. Cl.
CPC ..... *A47L 9/108* (2013.01); *A47L 5/24* (2013.01); *A47L 9/1625* (2013.01); *A47L 9/1683* (2013.01); *A47L 9/20* (2013.01)

(58) Field of Classification Search
CPC ..... A47L 5/24; A47L 9/108; A47L 9/1625; A47L 9/1683; A47L 9/20; A47L 9/1641;
(Continued)

(56) References Cited

U.S. PATENT DOCUMENTS 7,419,520 B2 * 9/2008 Lee ..... A47L 9/20 15/352
2004/0187253 A1 * 9/2004 Jin ..... B01D 46/0065 15/352
(Continued)

FOREIGN PATENT DOCUMENTS

CN 110432823 A 11/2019
EP 3375340 A1 * 9/2018 ..... A47L 9/1666
(Continued)

OTHER PUBLICATIONS

KR100459131B1_Description_ MachineTranslation (Year: 2021).*
(Continued)

*Primary Examiner* — Orlando E Aviles
*Assistant Examiner* — Jacob Adam Montgomery
(74) *Attorney, Agent, or Firm* — Birch, Stewart, Kolasch & Birch, LLP

(57) ABSTRACT

A cleaner is disclosed. The cleaner may include a housing having an opening through which air is introduced into the housing. The cleaner may also include a filtering unit
(Continued)

mounted in the inner space of the housing. The filtering unit may define a dust collection space between the filtering unit and the inner surface of the housing. In addition, the cleaning unit may be mounted to surround the filtering unit. A manipulation unit may raise or lower the cleaning unit within the dust collection space. Furthermore, brush protrusions may protrude from the cleaning unit toward the surface of the filtering unit.

16 Claims, 15 Drawing Sheets

(51) Int. Cl.
*A47L 9/16* (2006.01)
*A47L 9/20* (2006.01)

(58) Field of Classification Search
CPC ..... A47L 9/1616; A47L 9/16; A47L 9/1608; A47L 9/1666; A47L 9/1675; A47L 9/1691; A47L 9/19; B08B 1/002
USPC ..... 15/347
See application file for complete search history.

(56) References Cited

U.S. PATENT DOCUMENTS

| | | | | |
|---|---|---|---|---|
| 2005/0217067 | A1* | 10/2005 | Rew | A47L 9/20 15/352 |
| 2018/0132685 | A1* | 5/2018 | Muir | A47L 9/32 |

FOREIGN PATENT DOCUMENTS

| | | | | | |
|---|---|---|---|---|---|
| GB | 2449484 | A | * | 11/2008 | A47L 9/1625 |
| JP | 3699679 | B2 | | 7/2003 | |
| JP | 2017-213158 | A | | 12/2017 | |
| KR | 10-0459131 | B1 | | 12/2004 | |
| KR | 10-2005-0106191 | A | | 11/2005 | |
| KR | 20050106191 | A | * | 11/2005 | A47L 9/10 |
| KR | 10-0539762 | B1 | | 1/2006 | |
| KR | 20060117001 | A | * | 11/2006 | |
| KR | 10-1803389 | B1 | | 12/2017 | |

OTHER PUBLICATIONS

Translated Description KR20050106191 (Year: 2005).*
PCT International Search Report, dated Feb. 2, 2021, issued in International Application No. PCT/KR2020/015001 (3 pages).
Office Action and Search Report issued in Taiwanese Application No. 109140598 dated Oct. 5, 2021 (13 pages).

* cited by examiner

CLEANER

CROSS REFERENCE TO RELATED APPLICATION

The present application claims the benefit of the earlier filing date and the right of priority to Korean Patent Application No. 10-2019-0172519, filed on Dec. 20, 2019, the entire contents of which are incorporated herein for all purposes by this reference.

TECHNICAL FIELD

The present disclosure generally relates to a cleaner. More particularly, the present disclosure relates to a cleaner which has a cleaning unit capable of compressing dust accumulated inside a dust container without opening the dust container.

BACKGROUND

A cleaner is a device that performs cleaning by inhaling or scraping off dust or foreign matter in the area to be cleaned. Such a cleaner may be a manual cleaner performing cleaning while a user directly moves the cleaner or an automatic cleaner performing cleaning while automatically moving.

The manual cleaner may be classified as a canister cleaner, an upright cleaner, a handheld cleaner, and a stick cleaner depending on the type of a cleaner. Among them, the handheld cleaner includes a separating device that separates waste and dust from an air stream.

The separating device includes a centrifuge that generates one or more cyclones. The centrifuge includes a first cyclone provided with a dust collector having a wall. The dust collector is arranged at a lower side of the first cyclone, and the dust collector may be opened and closed by a base thereof (a lower cover). The base may be rotated on a hinge and allows the dust collector to be opened and closed.

A filter part having multiple through holes which may also function as a cover may be provided inside the first cyclone. A second cyclone may communicate with the first cyclone through the filter part. Air inside the first cyclone may pass through the filter part, and then flow to the second cyclone. In this case, while the air passes through the through holes of the filter part, dust contained in the air may block the through holes of the filter part. As the blocking of the through holes increases, the air may flow inefficiently, and the removal performance of the dust may deteriorate.

Accordingly, a user is required to periodically clean the filter part. To this end, the user is required to reach the filter part and clean the filter part after opening the dust collector by rotating the base which is the lower cover. Accordingly, it is not easy for the user to clean the filter part.

In addition, in the prior art, dust separated from the air stream in the first cyclone and the second cyclone falls downward and accumulates in the upper side of the base. When the cleaner stops working, the separated dust is stored in a low-density state in the dust collector. That is, the dust separated by the first cyclone occupies a large volume compared to its weight. Accordingly, although there is still sufficient free space inside the dust collector, the dust in a dust container is required to be frequently emptied to maintain dust collection performance.

To solve this, technologies in which a compression member (a cleaning part) that can compress dust accumulated in a dust collection part is mounted inside the dust collection part, and the dust is compressed by lowering the compression member from the outside without opening the base are disclosed in Japanese Patent No. 3699679 and US Patent Application Publication No. 2018-0132685. The compression member is mounted to surround the filter part, and can scrape off dust on the filter part while moving toward the base, and can compress dust accumulated in the dust collection part.

However, although such a compression member compresses dust accumulated in the dust collection part, thin foreign matter (e.g., hair) on the filter part may not be cleaned by the compression member. This is because when the thin foreign matter is on the filter part, the foreign matter may pass through a gap between the compression member and the filter part in the process of the movement of the compression member, making it difficult to scrape off the foreign matter. In particular, when thin and long foreign matter such as hair surrounds the filter part and is wound thereon, it is harder to scrape down the foreign matter to a cleaning part.

When the gap between the compression member and the filter part is decreased to solve this, the foreign matter can be scraped down more efficiently. However, due to the interference of the compression member with the filter part, the efficient movement of the compression member becomes difficult. In addition, when the compression member and the filter part are in close contact with each other, foreign matter may be stuck therebetween, and the foreign matter may not be discharged toward the dust collection part, and instead may be raised together with the compression member.

In addition, the conventional compression member may have a portion of an end part made of an elastic material so as to decrease the friction of the compression member with the outer surface of the filter part and perform efficient cleaning. Accordingly, in the manufacturing process of attaching the part made of an elastic material to the compression member or in the process of raising/lowering the compression member, the end part of the compression member may be curled or turned over.

SUMMARY

Accordingly, the present disclosure has been made keeping in mind the above problems occurring in the related art, and the present disclosure is intended to propose a cleaner, wherein a cleaning unit securing free space by compressing dust accumulated inside a dust container of the cleaner may be provided, and thin foreign matter such as hair may be scraped down by the cleaning unit in the process of the compression.

In addition, the present disclosure is intended to propose a cleaner, wherein in the process in which the cleaning unit is restored to an initial position after the cleaning unit scrapes down thin foreign matter toward the bottom of a dust collection space, the foreign matter does not rise together with the cleaning unit, but is left at the bottom of the dust collection space.

Furthermore, the present disclosure is intended to propose a cleaner, wherein a cleaning ring made of an elastic material is provided at the end of the cleaning unit, and in the process of attaching the cleaning ring to the cleaning unit or in the process of the raising/lowering of the cleaning unit, the cleaning ring may be prevented from being curled up.

In order to achieve the above objectives, according to one aspect of the present disclosure, there is provided a cleaner including: a housing having an introduction opening through which air is introduced; a filtering unit mounted in the inner space of the housing and defining a dust collection space between the filtering unit and the inner surface of the housing. In addition, the cleaning unit may be mounted to surround the filtering unit, and may be configured to be raised and lowered inside the dust collection space by operating in cooperation with a manipulation unit. Furthermore, one or more brush protrusions may protrude from the cleaning unit in a direction toward the surface of the filtering unit. During the raising/lowering of the cleaning unit, such brush protrusions may scrape down thin foreign matter such as hair on the outer surface of the filtering unit.

In addition, the one or more brush protrusions may protrude from an inner surface of the cleaning unit toward the surface of the filtering unit, and may include multiple brush protrusions surrounding the inner surface of the cleaning unit. Accordingly, each of the brush protrusions may act as a comb, and effectively remove thin and long foreign matter.

The cleaning unit may surround the filtering unit and be connected to the manipulation unit, and may include a cleaning body operating in cooperation with the manipulation unit. A guide flow path may be formed in the cleaning body, the guide flow path guiding air introduced to the introduction opening. A cleaning ring may be disposed on a lower part of the cleaning body and extend toward the bottom of the dust collection space. The cleaning ring may be disposed adjacent to the surface of the filtering unit, and may clean the surface of the filtering unit during the raising/lowering of the cleaning unit. In addition, the brush protrusions may protrude from the surface of the cleaning ring.

Additionally, one or more support ribs may protrude from the lower part of the cleaning body toward the bottom of the dust collection space, and may support the surface of the cleaning ring from which each of the brush protrusions protrudes. Accordingly, the support rib may support the brush protrusion even when the brush protrusion removes foreign matter.

In addition, the one or more support ribs may protrude toward the surface of the filtering unit by surrounding the cleaning body. A gap maintenance rib may protrude from each of the one or more support ribs in an opposite direction of a guide inclination surface of the cleaning ring. In this case, at least one brush protrusion may be arranged between two gap maintenance ribs adjacent to each other. Accordingly, the brush protrusions and the gap maintenance ribs may maintain a gap between the cleaning unit and the filtering unit constant, and during the raisin/lowering of the cleaning unit, the cleaning unit may be prevented from being eccentric and interfering with the filtering unit.

The brush protrusions may be provided in the cleaning ring constituting the cleaning unit, the cleaning ring being made of an elastic material. Accordingly, the friction of the brush protrusions with the filtering unit may be decreased.

In addition, the brush protrusions may extend in the raising/lowering direction of the cleaning unit, or in an inclining direction to the raising/lowering direction of the cleaning unit.

Furthermore, a lower inclining surface may be formed on the lower end of each of the brush protrusions directed toward the lower part of the dust collection space, the lower inclining surface having the protruding degree of the brush protrusion gradually decreasing downward. An upper inclining surface may be formed on the upper end of the brush protrusion directed toward the upper part of the dust collection space, the upper inclining surface having the protruding degree of the brush protrusions gradually decreasing upward. The upper inclining surface and the lower inclining surface may decrease friction between the brush protrusion and the filtering unit.

Furthermore, the lower end of the brush protrusion directed toward the dust collection space may be formed to be recessed toward the upper part of the brush protrusion. Accordingly, foreign matter may be moved by being more easily held in the lower part of the brush protrusion.

In addition, one or more holding ribs may be provided on the surface of the filtering unit by protruding toward the inner surface of the cleaning unit facing the surface of the filtering unit. The holding rib may hold foreign matter pulled down by the brush protrusion and prevent the foreign matter from rising together with the cleaning unit.

In addition, the cleaning unit moves between a first position at which the cleaning is raised and a second position at which the cleaning unit is lowered, and the one or more holding ribs may be provided on the lower part of the filtering unit such that at least a portion of the one or more holding ribs has a section overlapping with the cleaning unit located at the second position. Accordingly, a state in which thin foreign matter such as hair is collected at the lower side of the dust collection space may be maintained.

Furthermore, the one or more holding ribs may surround the surface of the filtering unit, and at least one brush protrusion may pass between the holding ribs adjacent to each other.

Additionally, when the cleaning unit is located at the second position at which the cleaning unit is completely lowered, the lower end of the brush protrusion may be located at a position lower than the lower end of each of the one or more holding ribs such that the lower end of the brush protrusion is closer to the bottom of the dust collection space than the lower end of the bolding rib. Accordingly, the foreign matter may be securely held and collected in the lower end of the holding rib.

In addition, a guide inclination surface may be formed on the upper end of each of the one or more holding ribs, the guide inclination surface having the protruding height of the holding rib gradually decreasing upward, and a holding step surface may be formed on the lower end of the holding rib, the holding step surface having an inclination angle steeper than the inclination angle of the guide inclination surface.

The cleaner of the present disclosure described above has the following effects.

First, according to the present disclosure, even without opening the dust container, the cleaning unit may compress dust collected in the dust container while moving (lowering) inside the dust collection space by surrounding the filtering unit. In the process, the brush protrusions protruding from the cleaning unit may also scrape down thin foreign matter such as hair on the outer side of the filtering unit. That is, although thin and long foreign matter such as hair is wound on the outer side of the filtering unit, the foreign matter may not be allowed to escape to a gap between the cleaning unit and the filtering unit and may be moved toward the bottom of the dust collection space by the cleaning unit. Accordingly, a user is not required to remove the wound foreign matter by themselves by opening the dust container, thereby improving usability.

In addition, while the cleaning unit of the present disclosure is being raised and lowered surrounding the filtering unit, the cleaning unit may scrape off foreign matter on the surface of the filtering unit, wherein the brush protrusions protruding from the cleaning unit may reduce the contacting area of the cleaning unit with the filtering unit, thereby decreasing the friction of the cleaning unit with the filtering unit occurring during the raising/lowering of the cleaning unit and facilitating the raising/lowering of the cleaning unit.

Particularly, the multiple brush protrusions and the support ribs protruding from the cleaning unit may maintain the gap between the cleaning unit and the filtering unit constant, whereby the cleaning unit may be prevented from being eccentric and interfering with the filtering unit during the raising/lowering of the cleaning unit, thereby facilitating the raising/lowering of the cleaning unit, and more stably performing the compression of dust and the cleaning of the filtering unit by using the cleaning unit.

In addition, in the present disclosure, the holding ribs may protrude from the outer surface of the filtering unit and hold foreign matter pulled down by the brush protrusions such that the foreign matter is not raised together with the cleaning unit, thereby maintaining the state of thin foreign matter such as hair collected at the lower side of the dust collection space, and effectively collecting dust toward the bottom of the dust collection space close to the dust container even without opening the dust container by a user.

In this case, the guide inclination surface may be formed on the upper end of the holding rib, the guide inclination surface having the protruding height of the holding rib gradually decreasing upward, so foreign matter such as hair may naturally slide over the holding rib. However, the holding step surface having a steep inclination may be formed on the lower end of the holding rib, so the foreign matter is difficult to slide over the holding rib in a direction opposite to the direction in which the foreign matter slides over the holding rib at the upper end thereof. Due to such a shape, the holding rib may more securely hold the foreign matter at the lower side of the dust collection space, thereby improving a dust compression rate by using the cleaning unit.

Furthermore, according to the present disclosure, even without a complicated structure or a major design change, only the brush protrusions protruding from the cleaning unit and the holding ribs protruding from the filtering unit may efficiently scrape down and collect thin and long foreign matter.

In addition, the cleaning ring made of an elastic material may be provided in the cleaning unit of the present disclosure, and the brush protrusions may be formed in the cleaning ring. Additionally, the rear surface of the cleaning ring may be supported by the support ribs. Such support ribs may prevent the cleaning ring from being deformed due to high temperature during double injection and from being curled up during the raising/lowering of the cleaning unit, thereby improving the quality reliability of the cleaning unit.

BRIEF DESCRIPTION OF THE DRAWINGS

The above and other objectives, features, and other advantages of the present invention will be more clearly understood from the following detailed description when taken in conjunction with the accompanying drawings, in which.

DETAILED DESCRIPTION

Figure 1:
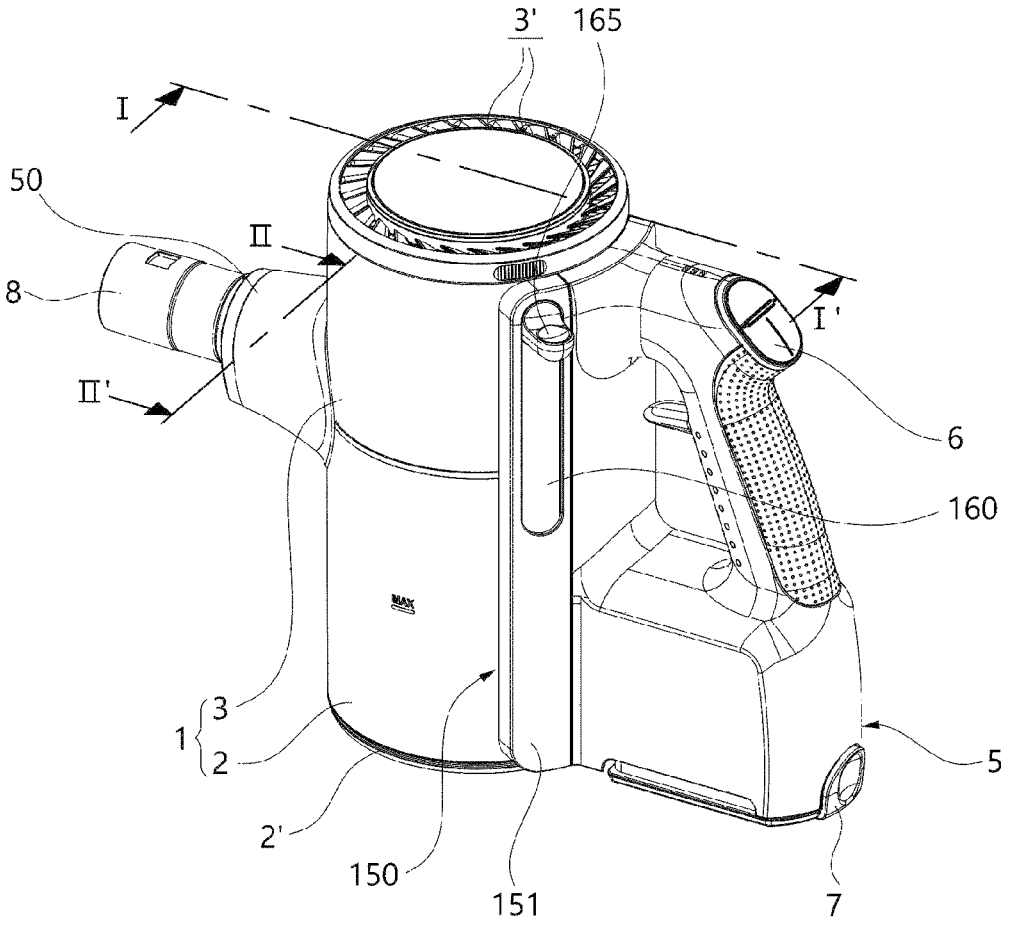
FIG. 1 is a perspective view illustrating the configuration of a cleaner, consistent with the disclosed embodiments.

Hereinafter, an embodiment of the present disclosure will be described in detail with reference to the accompanying drawings. It should be noted that in adding reference numerals to the components of each drawing, the same components have the same reference numerals when possible, even if they are displayed on different drawings. In addition, in describing the embodiment of the present disclosure, when it is determined that a detailed description of a related known configuration or function interferes with the understanding of the present disclosure, the detailed description is omitted.

The present disclosure relates to a cleaner, and more particularly, relates to a cleaner which separates dust from air by using a cyclone flow of air. Particularly, the cleaner of the present disclosure may include a cleaning unit 110 capable of compressing dust accumulated inside the dust container by using a manipulation lever on the outside of a housing without opening a dust container. Hereinafter, the present disclosure is described to be applied to a handheld vacuum cleaner as an example, but may be applied to other types of cleaners such as a canister cleaner.

Figure 2:
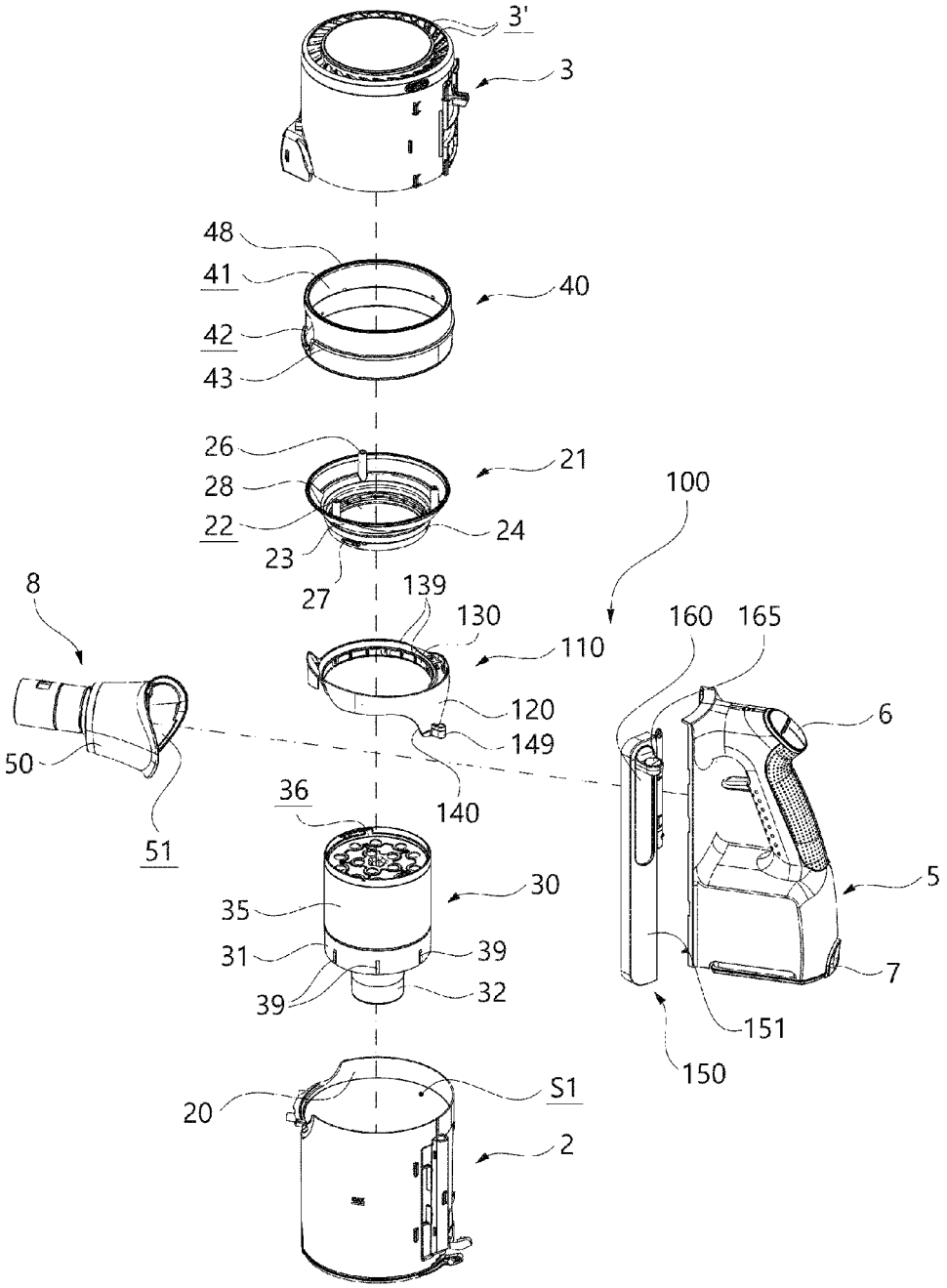
FIG. 2 is an exploded perspective view of components constituting the cleaner of FIG. 1, consistent with the disclosed embodiments.

FIG. 1 is a perspective view illustrating the configuration of a cleaner and FIG. 2 is an exploded perspective view of components constituting the cleaner. As illustrated in these drawings, first, a housing 1 may constitute the appearance and frame of the cleaner of the present disclosure. In some embodiments, housing 1 may be mainly divided into a first housing 2 and a second housing 3, and have an approximately cylindrical shape. Here, first housing 2 may also be referred to as dust container 2. When a lower cover 2' located at a lower side of dust container 2 is opened, dust container 2 may be opened. In some embodiments, first housing 2 and second housing 3 are disposed vertically. Alternatively, the first housing 2 and the second housing 3 may be disposed horizontally.

Referring now to FIG. 2, an inner space S1 may be provided inside first housing 2. Cleaning unit 110 and an inner housing 40, including a filtering unit 30 to be described below, may be mounted in inner space S1. Inner space S1 may also be referred to as dust collection space S1. In some embodiments, the shapes of first housing 2 and second housing 3 may be modifiable. Dust collection space S1 may be provided between the inner surface of first housing 2 and an outer surface of filtering unit 30. Dust collection space S1 may be regarded as an inner space of first housing 2. Here, an inner surface 20 of first housing 2 refers to an inner circumferential surface of first housing 2 corresponding to an opposite side of an outer surface of first housing 2 exposed to the outside.

Turning back to FIG. 1, a handle part 5 may be provided at one side of housing 1. Handle part 5 may be made as a component separate from housing 1, may be assembled with housing 1, and/or at least a portion of handle part 5 may be integrated with housing 1. Handle part 5 may be a portion which a user grasps, and a switch 6 which may be manipulated to be turned on/off may be provided at one side of handle part 5. In some embodiments, a battery 7 may be mounted on a lower side of handle part 5 to supply power for the operation of the cleaner.

Figure 3:
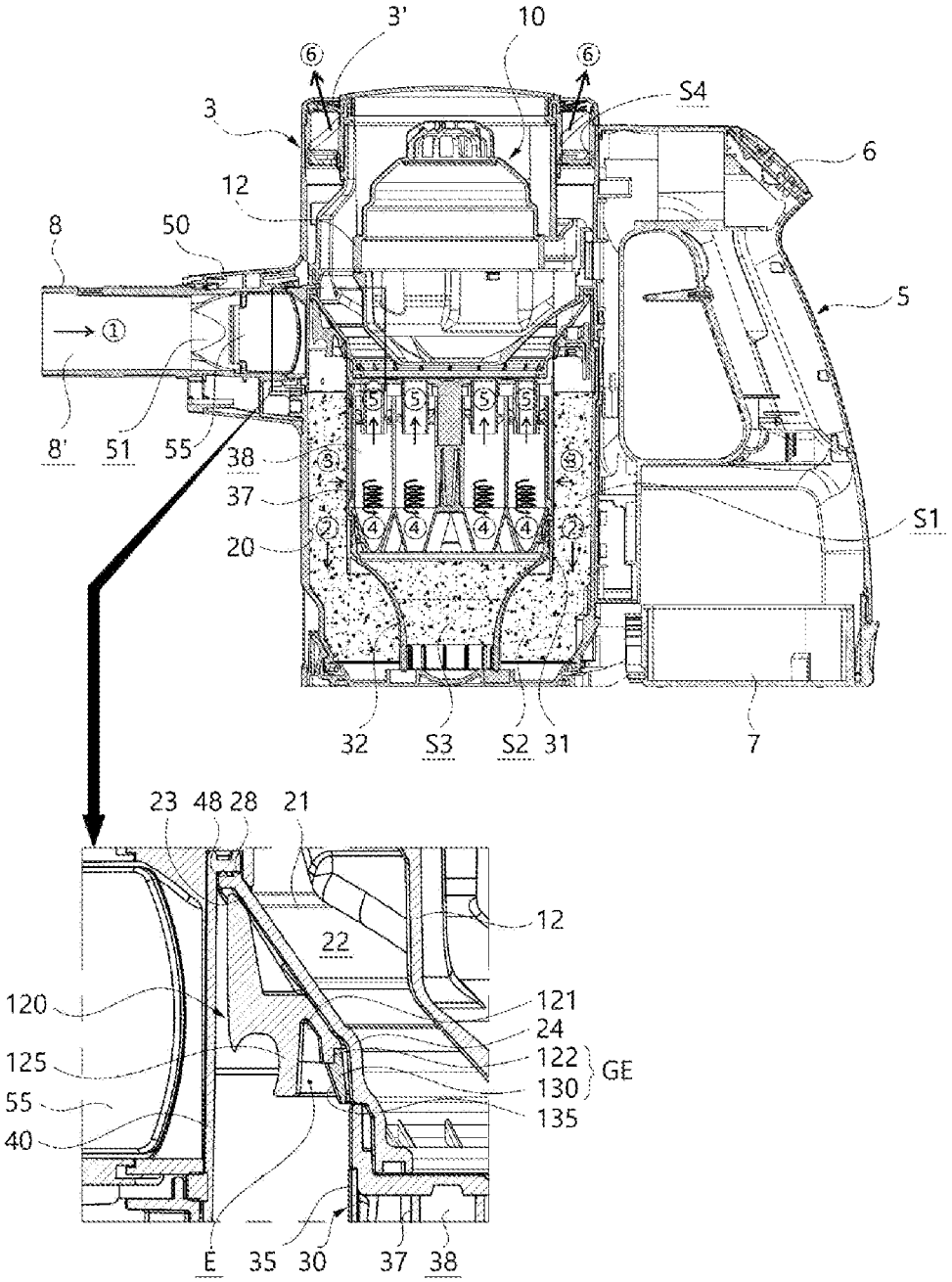
FIG. 3 is a sectional view taken along line I-I' of FIG. 1, consistent with the disclosed embodiments.

An introduction opening 8 may be formed at one side of housing 1. Introduction opening 8 may protrude to the opposite side of handle part 5, and an introduction space 8' may be defined therein, as described below in reference to FIG. 3. With further reference to FIG. 3, when the cleaner is operating, a suction force generated by a motor unit 10 may be transmitted to introduction opening 8, and external air having dust may be introduced to inner space S1 of the cleaner through introduction opening 8. In FIG. 1, introduction opening 8 is depicted as a short protrusion, but various cleaning devices (not shown) having varying lengths may be coupled to the front of introduction opening 8.

The cleaner is designed to suction air having dust, as described above, and foreign matter having various sizes may be included in the dust. That is, the dust may include foreign matter of very fine sizes, and/or foreign matter of much larger size such as hair H (see FIGS. 12 and 13), sand, or cookie crumbs. Hereinafter, the various foreign matter may be referred to as dust for convenience.

As illustrated in FIG. 1, a manipulation housing 151 forming part of a manipulation unit 150 may be coupled to housing 1, and a manipulation lever 160, which may be raised and lowered, may be assembled with manipulation housing 151, as described below in greater detail. When a user presses a button part 165 of manipulation lever 160, cleaning unit 110 may compress dust contained in dust collection space S1 while being lowered into dust collection space S1, and at the same time, may clean filtering unit 30 by scraping down its surface. That is, when a user lowers only manipulation lever 160 from the outside even without opening inner space S1 of the cleaner, dust contained inside dust collection space S1 may be compressed.

Referring to FIG. 3, motor unit 10 may be mounted inside second housing 3. Motor unit 10 mounted inside second housing 3 may provide the suction force of the cleaner. Although not shown, motor unit 10 may include an electric motor rotating by receiving power from a battery, and an impeller generating the suction force while rotating with a rotating shaft of an electric motor. Accordingly, motor unit 10 may be mounted inside second housing 3, but in FIG. 3, only a motor case 12 in which the motor unit 10 is mounted is illustrated, and the electric motor, the rotating shaft, and the impeller are omitted.

Referring to FIGS. 2 and 3, an air guide 21 may be provided inside housing 1. Air guide 21 may have the shape of a ring having a varying width which gradually becomes narrower downward, and a through hole 22 provided at its center. An outer surface of air guide 21 may guide the flow of air introduced through an introduction flow path 51 of introduction opening 8. The outer surface of air guide 21 may have an inclining shape, and the introduced air may be naturally induced downward.

An air guide surface 23 guiding the flow of air may be provided on the upper portion of air guide 21 and may have an inclining shape. The diameter of air guide 21 may gradually decrease toward the bottom of dust collection space S1, so air guide surface 23 may naturally become an inclining surface. When cleaning unit 110 is located at an initial position (see FIG. 3), cleaning unit 110 may surround the outer side of air guide surface 23, and the introduced air may be prevented from flowing through air guide surface 23. However, when cleaning unit 110 is located at a lowered position, air guide surface 23 may face introduction flow path 51 communicating with introduction opening 8, and thus may guide the flow of the introduced air (see FIG. 4).

For reference, the initial position may refer to a position at which cleaning unit 110 resides at a top position and communicates with an air introduction path of introduction opening 8, and the lowered position may refer to a position at which cleaning unit 110 resides at a low position and compresses dust contained in dust collection space S1, having scraped off dust on the outer surface of the filtering unit 30 as cleaning unit 110 was lowered.

A combination end 24 may protrude at the lower side of air guide surface 23. Combination end 24 may be a part by which air guide 21 may be assembled with filtering unit 30, and may be correspond to a part protruding more than the lower side of air guide surface 23. An assembly key 27 may protrude from combination end 24. Assembly key 27 may be inserted into an assembly groove 36 of filtering unit 30, so air guide 21 and filtering unit 30 may be assembled. Assembly key 27 and assembly groove 36 may be assembled to each other in a rotating manner.

An assembly boss 26 may protrude from air guide 21 by extending in a direction of the upper side thereof, that is, in a direction of second housing 3. Assembly boss 26 may allow air guide 21 to be assembled even with motor case 12 located inside second housing 3. Assembly boss 26 may be assembled with motor case 12 by a fastener such as a bolt.

A holding end 28 may be formed on the edge of the upper end of air guide 21. Holding end 28 may be formed by surrounding the edge of the upper end of air guide 21. When air guide 21 is assembled with inner housing 40, a corresponding holding portion 48 located on an edge of the inner side of inner housing 40 may be held in holding end 28. Such an appearance can be clearly seen in the enlarged view of FIG. 3.

In some embodiments, air guide 21 may be assembled with filtering unit 30. A cyclone part may be provided inside filtering unit 30. In some embodiments, a first cyclone part (not shown) and a second cyclone part 37 and 38 may be provided inside the cleaner. Second cyclone part 37 and 38 may be provided inside filtering unit 30. Dust may be more effectively filtered due to the provision of the first cyclone part and second cyclone part 37 and 38. In some embodiments, the first cyclone part may not be provided as a separate component, but may be formed by inner surface 20 of housing 1, air guide 21, and/or cleaning unit 110.

Filtering unit 30 may be mounted at the center of inner space S1 of first housing 2, and define dust collection space S1 between filtering unit 30 and the inner surface of first housing 2. Dust collection space S1 may be defined at the lower side of inner space S1 of first housing 2, and may be regarded as a first dust storage part S2 in which dust is accumulated.

In this case, second cyclone part 37 may be located inside the first cyclone part such that the size of housing 1 is minimized. Referring to FIG. 3, second cyclone part 37 may include multiple cyclone bodies 37 arranged in parallel. Air may flow through path 38 of each of cyclone bodies 37. In path 38, a centrifugal force may cause air to rise, and foreign matter to fall downwards.

A dust guide 31 may be provided at the lower side of second cyclone part 37 and path 38. Dust guide 31 may include a guide body 32 having a varying width gradually becoming narrower toward the lower side thereof, similar to a hopper, and a second dust storage part S3 may be provided inside guide body 32 to store dust separated from the air in second cyclone part 37 and 38. Second dust storage part S3 may be formed at the center of housing 1 and may be separated from first dust storage part S2 by guide body 32.

Referring to FIG. 3, the following will be a description of the air flow in the cleaner. While air (following the direction of arrow ①) and dust introduced through introduction opening 8 by the operation of motor unit 10 flow along the inner circumferential surface of the first cyclone part, the air and dust may be separated from each other.

The dust separated from the air may flow downward (following the direction of arrow ②), and be stored in first dust storage part S2. Meanwhile, the air separated from the dust may flow to second cyclone part 37 and 38. In this case, the air may flow through filtering unit 30 (following the direction of arrow ③). In the process of passing through filtering unit 30, the air may pass through a mesh net 35 located on the outer surface of filtering unit 30. In the process, dust having large particles may also be filtered through narrow holes formed in mesh net 35.

In addition, the air flowing to second cyclone part 37 and 38 may be once again separated from the dust by centrifugal force. The dust separated from the air in second cyclone part 37 may move downward, and be stored in second dust storage part S3 (following the direction of arrow ④).

Meanwhile, air separated from the dust in second cyclone part 37 and 38 may be discharged from second cyclone part 37 and 38 and rise toward motor unit 10 (following the direction of arrow ⑤). The risen air may pass through a pre filter (not shown) located at the outer side of motor unit 10. Air passing through the pre filter may pass through motor unit 10, and then pass through a HEPA filter located at a discharge space S4 of second housing 3, and be discharged to the outside (following the direction of arrow ⑥) through an air discharge opening 3'. Here, one or more of the pre-filter or the HEPA filter may be omitted.

In this case, the dust separated from the cyclone part may be accumulated in first dust storage part S2 and second dust storage part S3. The dust is light, so when a user opens first housing 2, i.e., the dust container 2, the dust may scatter outside. That is, the dust collected inside dust container 2 may not be accumulated into one lump, and may be difficult to be emptied. In some embodiments, to solve such a problem, a cleaning module 100 may be provided. Cleaning module 100 may include cleaning unit 110 compressing dust and manipulation unit 150, which may move cleaning unit 110.

Figure 4:
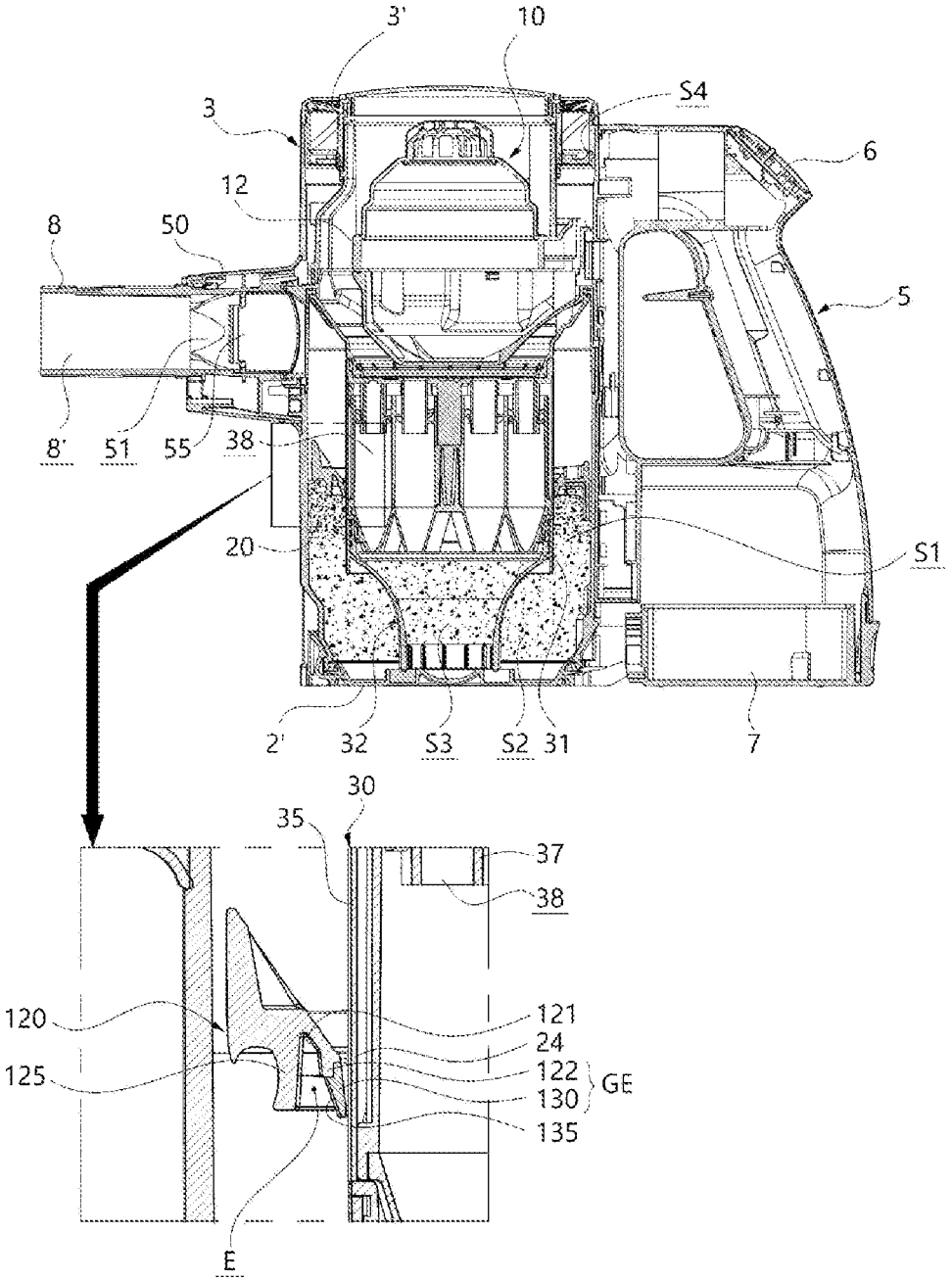
FIG. 4 is a sectional view illustrating a lowered state of a cleaning unit constituting the cleaner illustrated in FIG. 3, consistent with the disclosed embodiments.

For reference, in FIG. 4, cleaning unit 110 is illustrated to lower and scrape off dust on the outer surface of filtering unit 30. Referring to FIG. 4, cleaning body 120 and a cleaning ring 130 constituting cleaning unit 110 are lowered toward the lower portion of dust collection space S1. In the process of lowering of cleaning unit 110, cleaning unit 110 may compress the dust, and cleaning ring 130 may push down the dust on the outer surface of filtering unit 30. As illustrated in FIG. 4, dust of the upper portion of inner space S1 pressed down by cleaning body 120 and cleaning ring 130 may be in a compressed state. These components will be described again below.

Referring back to FIG. 2, mesh net 35 may be provided on the outer surface of filtering unit 30. Mesh net 35 may be mounted to filtering unit 30 so as to surround the outer surface thereof, and may function to filter dust contained in air introduced to second cyclone part 37 and 38 from dust collection space S1. To this end, multiple holes may be formed in mesh net 35. When a cleaner is used, the holes may be completely or partially blocked by dust and thus be required to be cleaned. The cleaning of mesh net 35 may be performed by cleaning unit 110.

Holding ribs 39 may be provided in filtering unit 30. Holding ribs 39 may protrude from the surface of filtering unit 30 and function to hold foreign matter. More precisely, when brush protrusions 139 of cleaning unit 110 scrape down thin and long foreign matter such as hair H, holding ribs 39 may function to hold and collect the foreign matter which is scraped down. Accordingly, the foreign matter moving down with brush protrusions 139 may be prevented from being raised together with brush protrusions 139 when cleaning unit 110 is restored to its initial position.

Figure 5A:
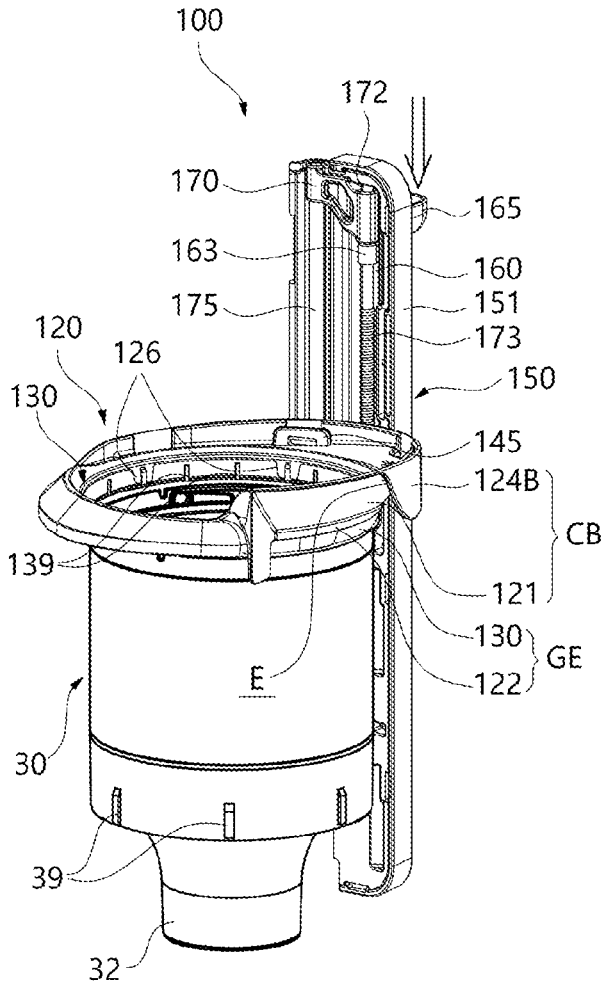
FIG. 5A is a perspective view illustrating the initial position of a cleaning unit where the cleaning unit and a manipulation unit may be raised to the upper part of a filtering unit, consistent with the disclosed embodiments.
Figure 5B:
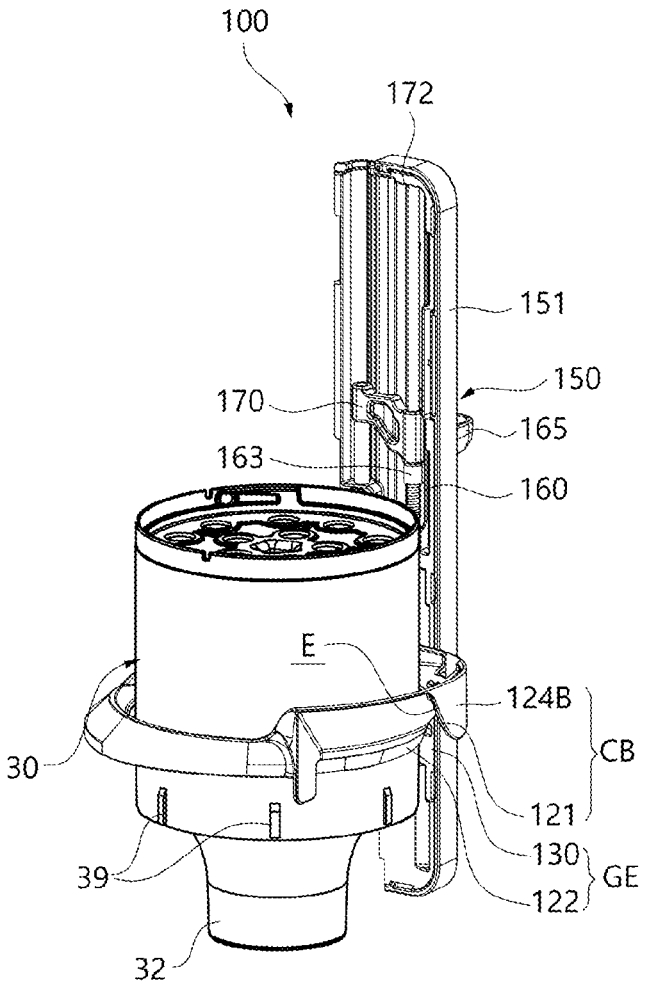
FIG. 5B is a perspective view illustrating the lowered position of a cleaning unit where the cleaning unit and a manipulation unit may be lowered to the lower part of a filtering unit, consistent with the disclosed embodiments.

Holding ribs 39 may protrude from the surface of filtering unit 30 toward the inner surface of cleaning unit 110 facing the surface of filtering unit 30. Referring to FIGS. 2, 5A, and 5B, holding ribs 39 may be provided on the surface of dust guide 31 in the surface of filtering unit 30. That is, holding ribs 39 may not protrude from mesh net 35, but may protrude from the surface of dust guide 31 corresponding to a lower part of mesh net 35.

Figure 6A:
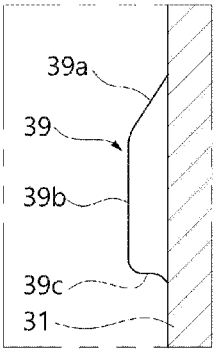
FIG. 6A is a side view illustrating a holding rib provided in a filtering unit with a curved holding step surface, slightly recessed in a direction toward a dust guide, consistent with the disclosed embodiments.
Figure 6B:
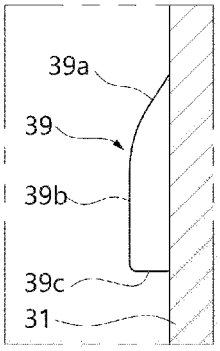
FIG. 6B is a side view illustrating a holding rib provided in a filtering unit with a flat holding step surface, consistent with the disclosed embodiments.
Figure 6C:
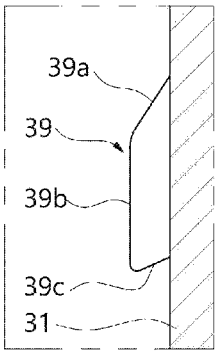
FIG. 6C is a side views illustrating a holding rib provided in a filtering unit with an upwardly inclined holding step surface, consistent with the disclosed embodiments.

FIGS. 6A, 6B, and 6C illustrate the shape of a holding rib 39 in detail. In some embodiments, holding rib 39 may be configured to have a vertical length, which may refer to a height of the holding rib, longer than a side-to-side length, which may refer to a width of the holding rib. Alternatively, the width and height of the holding rib 39 may be equal, or the width may be longer than the height.

A guide inclination surface 39*a* may be formed on the upper end of holding rib 39, guide inclination surface 39*a* having the protruding height of holding rib 39 gradually decreasing upward. When foreign matter such as hair H moves downward, guide inclination surface 39*a* allows the foreign matter to naturally slide over holding rib 39, and may be a curved surface or an inclining surface.

In addition, a holding step surface 39*c* may be formed on the lower end of holding rib 39. Holding step surface 39*c* may have an inclination angle steeper than the inclination angle of the guide inclination surface 39*a*. Holding step surface 39*c* may protrude from the lower end of holding rib 39, and the lower surface of holding step surface 39*c* may form a step in cooperation with the surface of dust guide 31. Accordingly, foreign matter may be held in the lower surface of holding step surface 39*c* directed toward the bottom of dust collection space S1.

A connecting surface 39*b* may be provided between guide inclination surface 39*a* and holding step surface 39*c* of holding rib 39. Connecting surface 39*b* may be a part extending in the moving direction of cleaning unit 110, that is, in a vertical direction relative to FIG. 6A, and may be configured as an inclining surface like guide inclination surface 39*a* or as a flat surface without inclination. Connecting surface 39*b* may be a part which is a section (height) in which holding ribs 39 may collect foreign matter at the lower side of cleaning unit 110 by interfering with thin foreign matter. In some embodiments, a height H1 of holding rib 39 (see FIG. 13A) may be longer than a height H2 of each of brush protrusions 139, which may allow the section of the holding rib 39 interfering with foreign matter to be sufficiently secured.

FIGS. 6A, 6B, and 6C illustrate different examples of holding rib 39. As illustrated in FIG. 6A, holding step surface 39*c* located at the lower end of holding rib 39 may be formed as a curved surface, and may be slightly recessed in a direction toward dust guide 31. In this case, foreign matter may be more easily held in holding step surface 39*c*, and be prevented from moving upward.

Of course, holding step surface 39*c* of holding rib 39 may be configured as a flat surface as illustrated in FIG. 6B, and may be configured as an upward inclining surface as illustrated in FIG. 6C. An angle between holding step surface 39*c* and the surface of dust guide 31 may be formed to be 90 degrees or less such that foreign matter is held in holding step surface 39*c*.

Although not shown, holding step surface 39*c* may have a width larger than widths of the remaining parts, that is, connecting surface 39*b* and guide inclination surface 39*a*. In this case, the lower surface of holding step surface 39*c* for holding foreign matter may be increased.

Holding rib 39 may include multiple holding ribs surrounding the surface of dust guide 31, and at least one brush protrusion 139 may pass between holding ribs 39 adjacent to each other. That is, when cleaning unit 110 raises and lowers, brush protrusions 139 of cleaning unit 110 may pass between two holding ribs 39. Accordingly, holding ribs 39 and brush protrusions 139 may not interfere with each other, and brush protrusions 139 may cause foreign matter to be held in holding ribs 39.

As described below, cleaning unit 110 may move between a first position at which cleaning unit 110 is raised and a second position at which cleaning unit 110 is lowered. Holding rib 39 may be disposed at the lower part of filtering unit 30 such that at least a portion of holding rib 39 has a section overlapping with cleaning unit 110 located at the second position. Accordingly, foreign matter may be collected at the lower part of filtering unit 30, and may be difficult to move to a position higher than the lower part of filtering unit 30 due to holding rib 39.

Inner housing 40 may be mounted to the upper portion of filtering unit 30. Inner housing 40 may be provided in inner space S1 of housing 1. In some embodiments, a portion of inner housing 40 may be arranged inside first housing 2, and the remaining portion thereof may be arranged inside second housing 3. Inner housing 40 may have an approximately circular frame, and may surround the outer sides of air guide 21 and cleaning unit 110 when mounted inside inner space S1.

A through-space 41 may be defined at the center of inner housing 40, and air guide 21 and cleaning unit 110 may be regarded to be located in through-space 41. As illustrated in FIG. 3, cleaning unit 110 at the initial position is located inside inner housing 40, and air guide 21 may be located at an inner side relative to the position of cleaning unit 110. Inner housing 40 may surround cleaning unit 110 at the initial position, and may function as a guide to at least a portion of cleaning unit 110 during the raising and lowering of cleaning unit 110.

A communication window 42 may be open at one side of inner housing 40. Communication window 42 may be a portion connecting introduction flow path 51, which is connected to introduction opening 8, to inner space S1. In some embodiments, referring to FIG. 17, communication window 42 may have an approximate "D" shape. Introduction opening 8 and cleaning unit 110 located at an inner side thereof may communicate with each other by communication window 42.

A sealing member 43 may be combined with the outer surface of inner housing 40. Sealing member 43 may be provided along the outer surface of inner housing 40, and limit an air flow between the upper portion and the lower portion of sealing member 43 relative thereto. That is, sealing member 43 may induce air to flow only along a formed path. For reference, inner housing 40 may be omitted, or first housing 2 or second housing 3 may be intentionally provided.

Referring to FIG. 2, an introduction housing 50 may be connected to introduction opening 8. Introduction housing 50 may be assembled with introduction opening 8 by surrounding introduction opening 8 or may be provided integrally to introduction opening 8. Introduction housing 50 may connect introduction opening 8 to housing 1 therebetween, and be larger in diameter than introduction opening 8. Introduction flow path 51 communicating with introduction opening 8 may be provided inside introduction housing 50.

Next, cleaning module 100 will be described below. Cleaning module 100 may include cleaning unit 110 and manipulation unit 150 allowing cleaning unit 110 to be operated. As illustrated in FIG. 2, cleaning unit 110 and manipulation unit 150 are components separate from each other, and may be assembled with each other to constitute a cleaning module 100. At least some components, including manipulation lever 160 of the manipulation unit 150, may protrude to the outside of housing 1, and a user may use cleaning module 100 even from an outside of housing 1.

FIGS. 5A and 5B illustrate cleaning module 100, with the cleaning module 100 surrounding filtering unit 30. As illustrated in FIGS. 5A and 5B, manipulation unit 150 may be provided in the form of standing along the raising/lowering direction of cleaning unit 110, and cleaning unit 110 may be mounted in a direction orthogonal to manipulation unit 150. Cleaning unit 110 may extend in the form of a cantilever from manipulation unit 150. Accordingly, cleaning unit 110 may be easily eccentric while raising and lowering. When cleaning unit 110 is eccentric, filtering unit 30 located at the center thereof may interfere with cleaning unit 110, so the raising and lowering of cleaning unit 110 may be interrupted. The structure of a gap maintenance rib 127 for solving this will be described below.

FIG. 5A illustrates the state of cleaning unit 110 located at the initial position thereof which is a first position, and FIG. 5B illustrates the state of cleaning unit 110 located at a lowered position thereof which is the second position after cleaning unit 110 lowers. In the process in which cleaning unit 110 is moving from the initial position to the lowered position, cleaning unit 110 may compress dust contained in dust collection space S1, and scrape off dust on mesh net 35. For reference, in FIG. 4, cleaning unit 110 may be lowered, but not to the lowest position, and may be regarded to be lowered to the middle of the lowering height of cleaning unit 110. In FIG. 5B, cleaning unit 110 may be located at a lowest position.

Referring to the structure of manipulation unit 150, manipulation housing 151 of manipulation unit 150 may be coupled to the outer surface of housing 1, and may extend in a vertical direction from first housing 2 to second housing 3. Two or more rails may be provided in manipulation housing 151, and include a fixed rail 172 and a movable rail 175. Fixed rail 172 and movable rail 175 may be mounted in longitudinal directions (i.e., vertical directions) relative to manipulation housing 151. Fixed rail 172 may be in a fixed state, and movable rail 175 may be raised and lowered together with cleaning unit 110. In some embodiments, each of fixed rail 172 and movable rail 175 may have the shape of a thin, long rod.

Manipulation lever 160 may be connected to fixed rail 172, and may be raised and lowered along the length of fixed rail 172. Button part 165 may be provided in manipulation lever 160. Manipulation lever 160 may be located inside manipulation housing 151 and not be exposed to the outside, but button part 165 may be exposed to the outside of manipulation housing 151 such that a user may press button part 165. When the user presses button part 165, manipulation lever 160 may lower movable rail 175 while lowering along fixed rail 172.

More precisely, a connection block 170 may be connected to button part 165. Connection block 170 may be located at the inner side of manipulation housing 151 and be raised and lowered along with button part 165. Connection block 170 may be fitted over fixed rail 172 so as to be raised and lowered along a length of fixed rail 172, and may also be connected to movable rail 175. Accordingly, connection block 170, together with button part 165, may be raised and lowered along fixed rail 172, and in the process, may raise and lower movable rail 175. As illustrated in FIG. 5A, connection block 170 may be mounted in a direction across fixed rail 172 and movable rail 175. Press end 163 is a press end coupled to connection block 170, and may be a part compressing a spring 173 during the lowering of connection block 170.

Spring 173 may be assembled with fixed rail 172 by being fitted thereover, and may be located at a position lower than a position of manipulation lever 160. Spring 173 may be compressed in the process in which connection block 170 is being lowered together with manipulation lever 160. When a force pressing button part 165 is released, spring 173 may restore manipulation lever 160 to an initial position thereof, that is, to the state in FIG. 5A while spring 173 is restored to an initial shape. Alternatively, spring 173 may be omitted.

Movable rail 175 may be mounted to manipulation housing 151 and be connected to manipulation lever 160, and thus may be raised and lowered together with manipulation lever 160. One end of movable rail 175 may be connected to a connecting plate 128 (hereinafter, also referred to as connection part 128) of cleaning unit 110. Accordingly, movable rail 175 and cleaning unit 110 may be raised and lowered together. Connection part 128 between movable rail 175 and cleaning unit 110 may be a part on which a load is focused due to an external force, and thus may be easily damaged or deformed. As described below, connecting plate 128 and reinforcement plate 140 may help prevent such damage or deformation.

When cleaning unit 110 is lowered as illustrated in FIG. 5B, thin and long foreign matter such as hair H may also be lowered together with cleaning unit 110. This takes place because brush protrusions 139 scrape down the foreign matter wound on mesh net 35. Furthermore, when cleaning unit 110 is lowered further relative to FIG. 5B and move to the second position (see FIGS. 12B and 13B), brush protrusions 139 may hold the foreign matter that has been pulled down in holding ribs 39 of filtering unit 30, and may be restored to an initial position (the state of FIG. 5A) together with cleaning unit 110.

Next, cleaning unit 110 will be described. Cleaning unit 110 may be mounted to surround filtering unit 30, and may be raised and lowered inside dust collection space S1 by manipulation unit 150. In this case, at least a portion of cleaning unit 110 located at the initial position may be connected to the air introduction path extending from introduction opening 8 and thus cleaning unit 110 may function to guide the flow of the air. Here, the connection between cleaning unit 110 and the air introduction path may mean that at least a portion of cleaning unit 110 is located in the air introduction path. The air introduction path may be regarded to include introduction opening 8 and introduction flow path 51 of introduction housing 50.

That is, cleaning unit 110 may function to (i) guide the flow of the introduced air at the initial position, (ii) compress dust contained in dust collection space S1 in the process of lowering, (iii) allow a guide edge GE thereof to scrape mesh net 35 of filtering unit 30 and remove dust while raising and lowering, and (iv) allow brush protrusions 139 located on the outer surface of cleaning ring 130 of guide edge GE to deliver hair H on the outer surface of filtering unit 30 up to the lower end of filtering unit 30.

Figure 7:
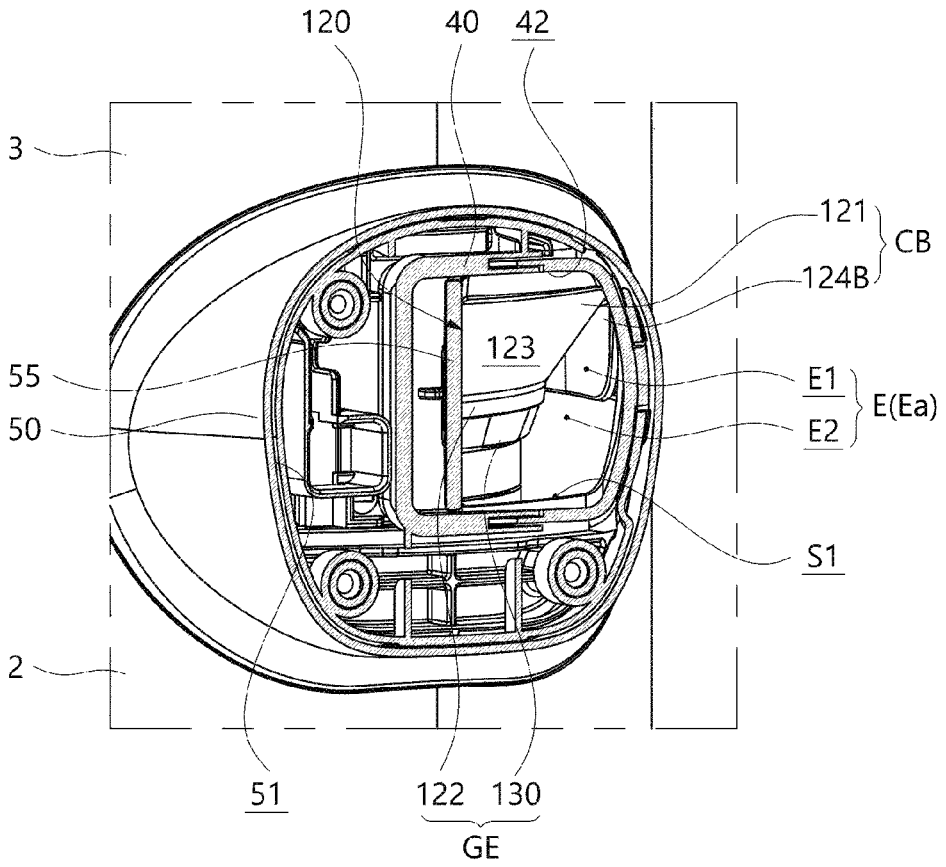
FIG. 7 is a sectional view taken along line II-II' of FIG. 1, consistent with the disclosed embodiments.

Referring to FIG. 7, cleaning unit 110 may be connected to introduction flow path 51 of introduction housing 50. Guide flow path E includes an entrance Ea, and may allow air to flow spirally along the guide flow path E (see FIGS. 3, 5A, 5B and 8). That is, cleaning unit 110, inner surface 20 of housing 1, and air guide 21 may constitute the first cyclone part such that the introduced air first flows in cyclone.

As described again below, referring to entrance Ea of guide flow path E, guide flow path E may include a first guide flow path E1 located at a relatively upper portion and formed between a guide wall 121 and a guide fence 124B of cleaning body 120, and a second guide flow path E2 located at a relatively lower portion and formed between guide edge GE and inner surface 20 of housing 1.

Figure 8:
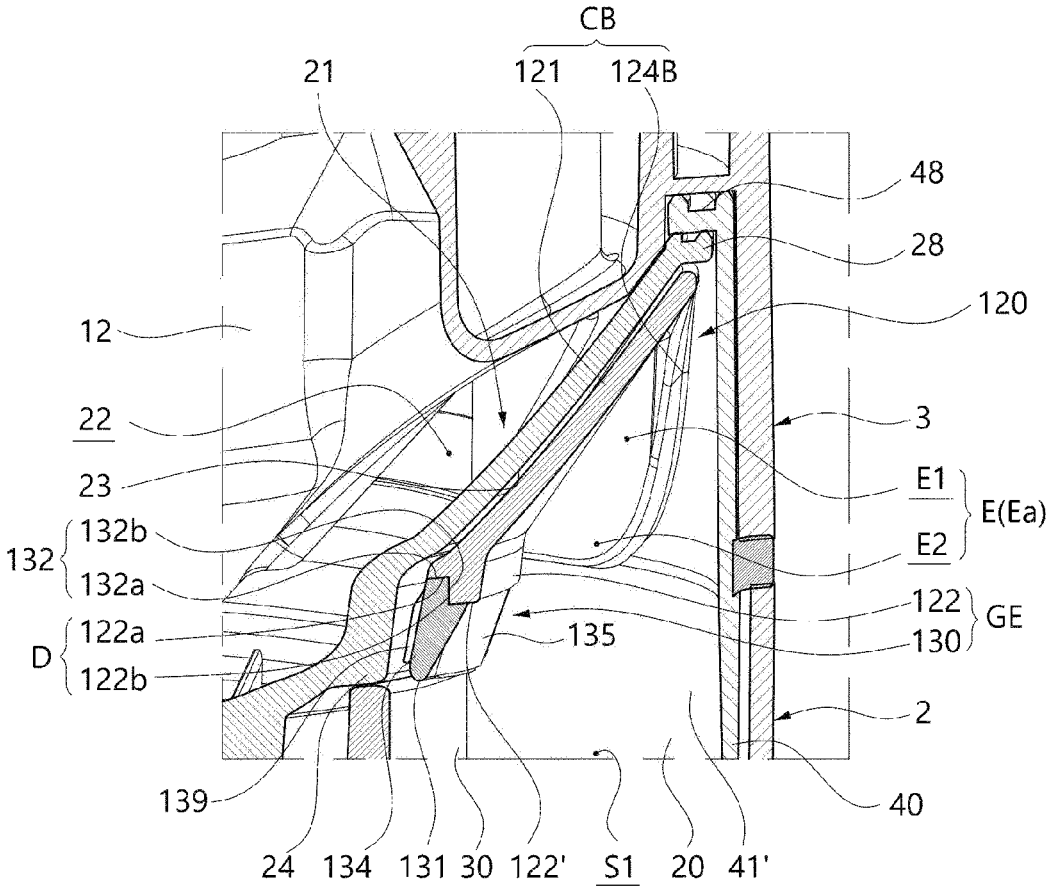
FIG. 8 is a sectional view illustrating the configuration of an air introduction part through which air is introduced in the cleaner, consistent with the disclosed embodiments.

External air may be introduced along the space located inside introduction opening 8 (see FIG. 2) and pass through introduction flow path 51 of introduction housing 50. The introduced air may be introduced inward through an air introduction part 123. Air introduction part 123 may be provided at entrance Ea of guide flow path E of cleaning unit 110, and may communicate with introduction opening 8. Air introduction part 123, at which a portion of guide fence 124B is omitted, may function to communicate an air flow path with introduction opening 8. Referring to FIGS. 2 and 8, air introduction part 123 may communicate with introduction flow path 51 through communication window 42 of inner housing 40.

Referring to FIG. 8, which illustrates the inside of the entrance of the cleaner in greater detail than FIG. 7, air introduction part 123 may open entrance Ea of guide flow path E, and air introduced at entrance Ea of guide flow path E and dust contained in the air may forcefully collide with cleaning unit 110. The dust may be introduced further inward along guide flow path E after the collision.

In this case, when flat foreign matter is introduced to entrance Ea in standing directions (in a direction of height larger in size than width), the foreign matter may efficiently pass through entrance Ea of guide flow path E which is narrow in width. However, when the foreign matter is introduced to entrance Ea with strong force in lying directions (in a direction of width larger in size than height), the foreign matter may collide with cleaning unit 110, and then be bounced toward inner surface 20 of housing 1 or inner surface 41' of inner housing 40 by a reaction force to the collision, so the foreign matter may be held therebetween. However, in the present disclosure, such a holding may be prevented by guide edge GE to be described below.

Meanwhile, as illustrated in FIGS. 3 and 7, a guide blade 55 may be provided in introduction housing 50. Guide blade 55 may be a structure having a plate shape installed in a direction of blocking one side of an exit Eb of introduction flow path 51. Guide blade 55 may set the path of the introduced air, and more precisely, induce the flow of air to entrance Ea of guide flow path E.

Figure 9:
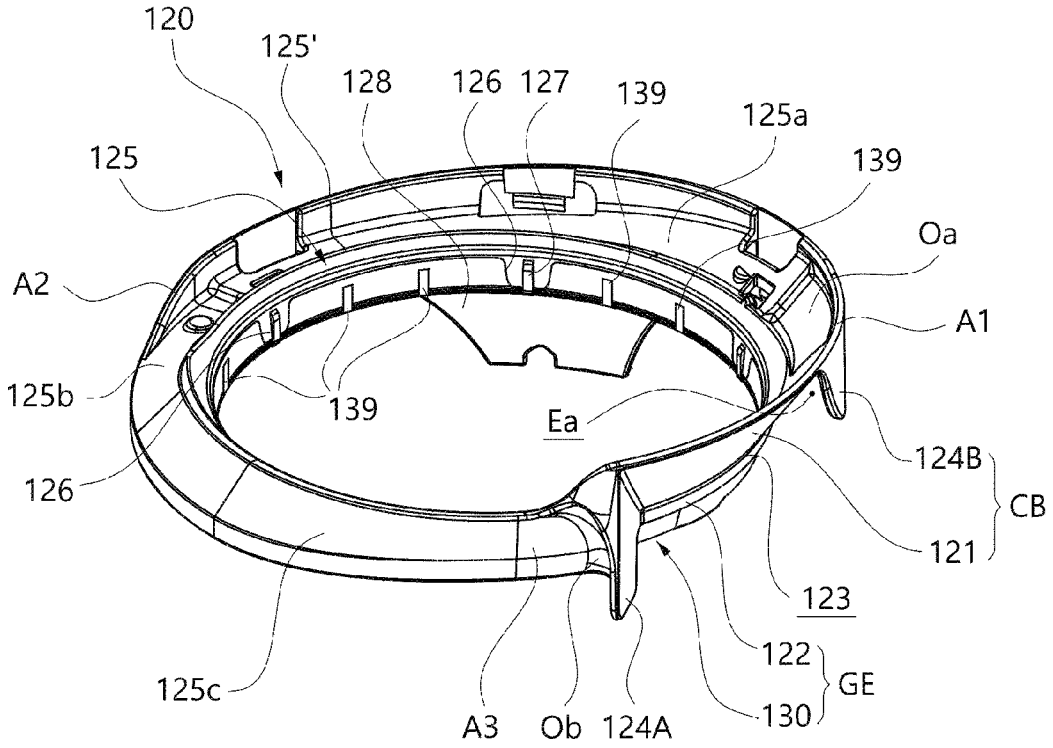
FIG. 9 is a perspective view illustrating the configuration of the cleaning unit, consistent with the disclosed embodiments.

Referring to FIG. 9, a duct blade 124A may be mounted to cleaning body 120 of cleaning unit 110. Duct blade 124A may stand in a direction of blocking one side of air introduction part 123. Duct blade 124A may allow the flow path of air to be formed in one direction relative to duct blade 124A, that is, toward entrance Ea of guide flow path E. Furthermore, duct blade 124A may have a shape extending longitudinally in the raising/lowering direction of cleaning unit 110, and function to increase the strength of cleaning body 120.

Duct blade 124A of cleaning unit 110 and guide blade 55 of introduction housing 50 may be arranged to continue each other. That is, duct blade 124A and guide blade 55 may form one continuous air flow path, and allow the introduced air to flow to entrance Ea of guide flow path E through the air introduction opening.

Next, cleaning unit 110 will be described in further detail. Referring to FIG. 9, cleaning unit 110 may mainly be composed of cleaning body 120 and guide edge GE. Cleaning body 120 may be a ring-shaped structure that forms the appearance of cleaning unit 110, and guide edge GE may extend from the lower end of cleaning body 120. In the embodiment, guide edge GE may be composed of coupling end part 122 of cleaning body 120 and cleaning ring 130. Alternatively, only cleaning ring 130 may constitute guide edge GE. Guide edge GE may be a closed curve path having a ring shape. At least a portion of guide edge GE may be located in the air introduction path extending from introduction opening 8, and may guide the flow of the introduced air.

Cleaning body 120 may have an approximate ring shape and surround filtering unit 30, and may be connected to manipulation unit 150. Cleaning body 120 may include guide wall 121 and guide fence 124B. Guide wall 121 and guide fence 124B may be configured to be integrated with each other. Guide wall 121 may continuously extend in the circumferential direction of cleaning body 120, and have the inclining surface on the surface thereof, and guide edge GE may be provided on the lower portion thereof.

In addition, guide fence 124B may extend parallel to guide wall 121, and be spaced apart from guide wall 121 in a direction of inner surface 20 of housing 1. Accordingly, guide flow path E which is the air flow path may be formed between guide fence 124B and guide wall 121. As illustrated in FIG. 7, guide fence 124B may be formed at an end of introduction opening 8 along the vertical direction (relative to FIG. 7) of introduction opening 8, and the height of guide flow path E may be formed to have at least the height of guide fence 124B.

More precisely, since guide fence 124B is omitted in air introduction part 123, guide flow path E may be formed between the outer surface of guide wall 121 and inner surface 20 of housing 1. In an inner side to air introduction part 123, guide flow path E may be formed between the outer surface of guide wall 121 and inner surface 124BI of guide fence 124B. That is, guide wall 121 and guide fence 124B may constitute a guide duct CB. Guide flow path E may be open in a direction of dust collection space S1 located thereunder, and may induce the flowing air downward.

As for guide fence 124B, guide fence 124B may be provided along the outer edge of cleaning body 120 of cleaning unit 110, and face inner surface 20 of housing 1, so that guide fence 124B may form guide flow path E at the inner side thereof by extending along inner surface 20 of housing 1. That is, guide fence 124B may be in close contact with inner surface 20 of housing 1 or may be located at a position close thereto by being spaced apart by a predetermined distance, so air may be prevented from flowing to a position between guide fence 124B and inner surface 20 of housing 1.

As illustrated in FIG. 8, coupling end part 122 may be provided on the lower end of guide wall 121. Coupling end part 122 may be a portion extending downward from the lower end of guide wall 121, and cleaning ring 130 may be coupled to coupling end part 122. The surface of coupling end part 122 and the surface of cleaning ring 130 may constitute guide edge GE, and may form a guide inclination surface 135. That is, the surface of coupling end part 122 may extend to gradually incline downward toward dust collection space S1, so an inclining surface may be formed on the surface thereof. Such an inclining surface may induce some of the reaction forces occurring during the collision of large foreign matter with the inclining surface to be directed downward.

Guide wall 121 may be provided in an inclining direction to the raising/lowering direction of cleaning unit 110, and may guide the flow of the air introduced through introduction opening 8 when cleaning unit 110 is located at the initial position. Referring to FIG. 8, the outer surface of guide wall 121 can be seen to extend slantingly. Since the outer surface of guide wall 121 may extend to incline downward, guide wall 121 may efficiently move the air downward.

Preferably, guide wall 121 of cleaning body 120 may extend to incline such that a gap between guide wall 121 and inner surface 20 of housing 1 increases downward toward guide edge GE, and may induce the flow of air downward, and the width of guide wall 121 may be increased to improve the air flow.

Connecting plate 128 may be provided in cleaning body 120. As illustrated in FIG. 9, connecting plate 128 may have the structure of a plate shape extending in the raising/lowering direction of cleaning unit 110, and may be raise and lower in the state of being in close contact with inner surface 20 of housing 1. Connecting plate 128 may be a part connecting manipulation unit 150 to cleaning body 120.

Cleaning body 120 may be regarded to extend in the form of the cantilever from manipulation unit 150 (see FIG. 5). Accordingly, a large load may be applied to connection part 128 located between manipulation unit 150 and cleaning body 120. Accordingly, connection part 128 is required to be reinforced. To this end, connecting plate 128 may extend along the raising/lowering direction of cleaning unit 110, and may provide a wide connection part 128. In some embodiments, reinforcement plate 140 (see FIG. 2) may be correspondingly coupled to connecting plate 128, so the strength of connection part 128 may be further increased.

An upper cleaning part 125 may be formed on the upper surface of cleaning body 120 corresponding to the opposite side of guide flow path E. Upper cleaning part 125 may be provided as a continuous path along the circumferential direction of cleaning body 120. When air flows toward upper cleaning part 125, dust accumulated on the upper surface of cleaning body 120 may be removed. Most of the introduced air may flow along guide flow path E, but some of the air may be introduced to the upper side of cleaning body 120, so dust may be accumulated on the upper surface of cleaning body 120. Even when air is introduced while cleaning unit 110 is lowered, dust may be accumulated on the upper surface of cleaning body 120. The dust may be removed through the structure of upper cleaning part 125.

Referring to FIG. 9, the entrance Oa of upper cleaning part 125 starting at a position adjacent to air introduction part 123 may be formed at a location higher than the exit Ob of upper cleaning part 125. That is, the height of upper cleaning part 125 may gradually decrease along the circumferential direction thereof from the entrance Oa to the exit Ob. A first section 125*a* constituting upper cleaning part 125 may be the highest portion, and a second section 125*b* extending from first section 125*a* may be lower than first section 125*a*. Furthermore, a third section 125*c* may be a portion closest to duct blade 124A which is the exit Ob and may be lowest.

In this case, the height of upper cleaning part 125 may decrease from first section 125*a* toward third section 125*c*, but the height of a middle portion therebetween may slightly increase. For example, for the strength reinforcement of cleaning body 120, a section in which the height of upper cleaning part 125 increases may be provided. In some embodiments, the height of a portion of second section 125*b* may slightly increase and then decrease.

An upper fence 125' may protrude from the edge of cleaning body 120. Upper fence 125' may form the flow path of air flowing in upper cleaning part 125. Upper fence 125' may protrude upward from the edge of the upper surface of cleaning body 120, and thus may constitute a portion of upper cleaning part 125, and face inner space S1 of housing 1.

Upper fence 125' may be provided from first section 125*a* to second section 125*b*, but may not be omitted in third section 125*c*. This is because third section 125*c* may be a section in which the air flowing along the circumferential direction of cleaning body 120 is discharged. The height of upper fence 125' may be highest at starting point A1 of first section 125*a*, and decrease toward end point A2 of second section 125*b*. Upper fence 125' may be omitted in entire section A3 of third section 125*c*.

Referring to FIG. 8, in some embodiments, cleaning ring 130 may be coupled to the lower end of guide wall 121 of cleaning body 120. Cleaning ring 130 may be coupled to and raise and lower with coupling end part 122 located at the lower end of guide wall 121, and may function to compress dust and scrape off dust on mesh net 35 during raising and lowering. Cleaning ring 130 may be made of an elastic material, for example, rubber or silicone, and may be transformed to some extent in the process of the compression such that cleaning unit 110 may more efficiently raise and lower. Of course, cleaning ring 130 may be made of the elastic material, and this may be advantageous in scraping off the dust on the outer surface of mesh net 35.

Cleaning ring 130 may be approximately ring-shaped. In some embodiments, cleaning ring 130 may be coupled to coupling end part 122 of guide wall 121 through double injection. Front surface 135 of cleaning ring 130 coupled to coupling end part 122 may face inner surface 20 of housing 1, and rear surface 134 of cleaning ring 130 may face the surface of filtering unit 30 while cleaning unit 110 is lowering. Front surface 135 of cleaning ring 130 may be guide inclination surface 135, so the same reference numeral is assigned thereto.

As the coupling portion between cleaning ring 130 and guide wall 121 is seen in FIG. 8, in upper surface 132 of cleaning ring 130, an upper coupling portion 132*a* and a first surface coupling portion 132*b* are connected to each other so as to be orthogonal to each other, and a lower coupling portion 122*a* and a second surface coupling portion 122*b* formed on the lower surface of coupling end part 122 engaging with upper coupling portion 132*a* and first surface coupling portion 132*b* may form a step part D. Step part D may have an L-shaped section, which may increase a coupling area between cleaning ring 130 and guide wall 121.

Accordingly, the coupling force between upper surface 132 of cleaning ring 130 and the lower surface of guide wall 121 engaged with each other may be weaker compared to the coupling force between cleaning ring 130 and guide wall 121 when front surface 135 and rear surface 134 of cleaning ring 130 are engaged with guide wall 121. However, in some embodiments, a support rib 126 may be provided in guide wall 121 to compensate for this.

Referring to FIG. 9, support rib 126 may be provided in cleaning unit 110. Support rib 126 may protrude from the lower portion of cleaning body 120. More precisely, support rib 126 may protrude downward from coupling end part 122 of guide wall 121. Support rib 126 may protrude toward the bottom of dust collection space S1, and may support rear surface 134 (see FIG. 8) of cleaning ring 130 which is the opposite surface of guide inclination surface 135 of cleaning ring 130. That is, support rib 126 may support a portion corresponding to the lower surface of cleaning ring 130 at the rear thereof.

Multiple support ribs 126 may be provided on the circumference of cleaning body 120, and at least a portion of each of support ribs 126 may protrude up to or more than the lower end of cleaning ring 130.

In some embodiments, cleaning ring 130 may be coupled to cleaning body 120 through double injection. In the process of double injection, cleaning ring 130 may be deformed due to high temperature, but support rib 126 may prevent the deformation. Furthermore, even in the process of the raising and lowering of cleaning unit 110, support rib 126 may prevent cleaning ring 130 from curling. Of course, cleaning ring 130 may be attached to cleaning body 120 by an adhesive, or may be assembled therewith in various ways such as a forcible fitting manner and a protrusion coupling manner.

In addition, gap maintenance rib 127 may protrude from support rib 126. Gap maintenance rib 127 may extend in the raising/lowering direction of cleaning unit 110, and prevent cleaning unit 110 from being eccentric in the process of the raising and lowering of cleaning unit 110. Without gap maintenance rib 127, when cleaning unit 110 is eccentric, cleaning ring 130, which may be made of a flexible material, may be curled up or turned over while rubbing against mesh net 35. Gap maintenance rib 127 may solve such a problem.

Referring to FIG. 8, a step 122' may be provided in coupling end part 122. Step 122' may be formed by having coupling end part 122 protrude more than cleaning ring 130 in the direction of inner surface 20 of housing 1. This may cause the thickness of coupling end part 122 to be larger than the thickness of cleaning ring 130. Due to step 122', the lower surface of coupling end part 122 to which cleaning ring 130 may be double injected and coupled may be wider, so stable coupling between cleaning ring 130 and coupling end part 122 may be performed, and the double injection operation of the cleaning ring may be facilitated.

Cleaning unit 110 may include brush protrusion 139. Brush protrusion 139 may protrude from cleaning unit 110 in a direction toward the surface of filtering unit 30, and may more efficiently remove thin foreign matter such as hair H wound on the surface of filtering unit 30. Brush protrusion 139 may protrude from the inner surface of cleaning unit 110 toward the surface of filtering unit 30, and may include multiple brush protrusions surrounding the inner surface of cleaning unit. Referring to FIG. 2, multiple brush protrusions 139 are seen to be arranged on the inner surface of cleaning unit 110.

Multiple brush protrusions 139 may act as a comb. During the lowering of cleaning unit 110, brush protrusions 139 may scrape down thin foreign matter such as hair H on the outer surface of filtering unit 30. That is, although the thin and long foreign matter such as hair H is wound on the outer surface of filtering unit 30, the foreign matter may not be allowed to escape to a gap between cleaning unit 110 and filtering unit 30, and may be moved toward the bottom of dust collection space S1 by cleaning unit 110. Accordingly, a user may not be required to remove the wound foreign matter by themselves by having to open dust container 2.

In addition, each of the brush protrusions 139 may be a structure protruding further from the inner surface of cleaning unit 110, and a structure being in contact with the surface of filtering unit 30. Accordingly, brush protrusions 139 protruding from cleaning unit 110 may prevent cleaning unit 110 and filtering unit 30 from being in surface contact with each other and reduce a contact area therebetween, thereby reducing friction occurring during the raising/lowering of cleaning unit 110.

Particularly, in cooperation with brush protrusion 139, gap maintenance rib 127 provided in support rib 126 may maintain the gap between cleaning unit 110 and filtering unit 30 constant. Referring to FIG. 9, gap maintenance rib 127 is seen to be arranged between brush protrusions 139. Accordingly, brush protrusions 139 and gap maintenance rib 127 together may maintain the gap between cleaning unit 110 and filtering unit 30. In some embodiments, at least one brush protrusion 139 may be arranged between two support ribs 126.

In some embodiments, brush protrusions 139 may be formed in cleaning ring 130 of cleaning unit 110. Cleaning ring 130 may be made of an elastic material. That is, brush protrusions 139 may be made of an elastic material such as rubber or silicone, which prevents the friction of the brush protrusions with the surface of filtering unit 30 from increasing. Of course, brush protrusions 139 may not be required to be disposed in cleaning ring 130, but may be disposed on the inner surface of cleaning body 120.

Figure 10A:
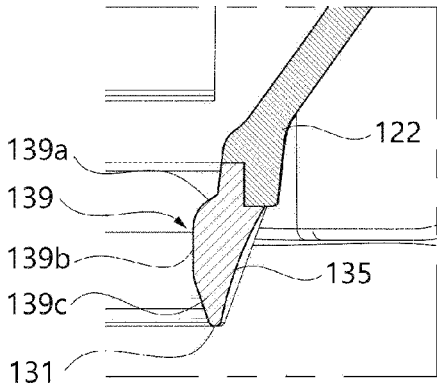
FIG. 10A is a sectional view illustrating a brush protrusion with an upper inclining surface provided in a cleaning ring, consistent with the disclosed embodiments.
Figure 10B:
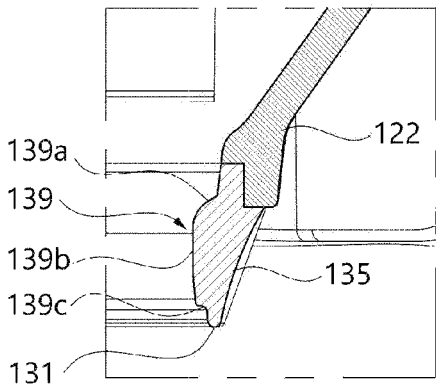
FIG. 10B is a sectional view illustrating a brush protrusion with a lower inclining surface provided in a cleaning ring, consistent with the disclosed embodiments.

FIGS. 10A and 10B illustrate sectional views of the structure of brush protrusion 139. Referring to FIG. 10A, an upper inclining surface 139*a* may be formed on the upper end of brush protrusion 139 directed toward the upper part of dust collection space S1, the upper inclining surface having the protruding degree of brush protrusion 139 gradually decreasing upward. Upper inclining surface 139*a* may be a curved surface or an inclining surface to decrease the friction of cleaning unit 110 with filtering unit 30 during the raising of cleaning unit 110.

In addition, a lower inclining surface 139*c* may be formed on the lower end of brush protrusion 139 directed toward the lower part of dust collection space S1, the lower inclining surface having the protruding degree of brush protrusion 139 gradually decreasing downward. Lower inclining surface 139*c* may have the shape of a curved surface or an inclining surface. The contacting area of lower inclining surface 139*c* with filtering unit 30 may be decreased and thus friction therebetween may be decreased during the lowering of cleaning unit 110.

A brush surface 139*b* may be formed between upper inclining surface 139*a* and lower inclining surface 139*c*. Brush surface 139*b* may be the most protruding part of brush protrusion 139 in the direction toward the surface of filtering unit 30. In some embodiments, brush surface 139*b* may have a planar structure, but may have the shape of an inclining surface or curved surface. A gap may exist between brush surface 139*b* and the surface of filtering unit 30. In some embodiments, the width of the gap may be 0.1 mm to 10.0 mm. Such a gap may decrease during the raising/lowering of cleaning unit 110, and brush protrusions 139 may touch the surface of filtering unit 30. However, due to the presence of upper inclining surface 139*a* and/or lower inclining surface 139*c*, the friction of brush protrusions 139 with filtering unit 30 may be decreased.

In some embodiments, brush protrusion 139 may be configured to have a vertical length thereof, corresponding to the height of brush protrusion 139, longer than a side-to-side length thereof corresponding to the width of brush protrusion 130. Brush surface 139*b* may be longer than upper inclining surface 139*a* and lower inclining surface 139*c*. Although foreign matter is not held in lower inclining surface 139*c*, the foreign matter may be moved together with brush surface 139*b*. Of course, alternatively, the width and height of brush protrusion 139 may have the same size, or the width may be longer than the height.

FIG. 10B illustrates a different example of brush protrusion 139. As illustrated in FIG. 10B, at least a portion of lower inclining surface 139*c* may have a shape of being recessed in the direction toward guide inclination surface 135 which is located at the inner side of cleaning ring 130. In this case, foreign matter may be more easily held in lower inclining surface 139*c*.

Figure 11A:
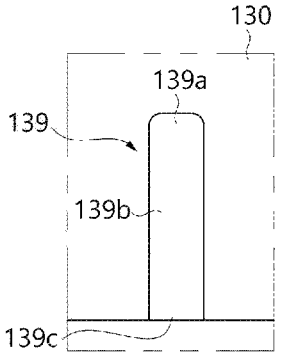
FIG. 11A is a front view illustrating a brush protrusion extending in a vertical direction provided in the cleaning ring, consistent with the disclosed embodiments.
Figure 11B:
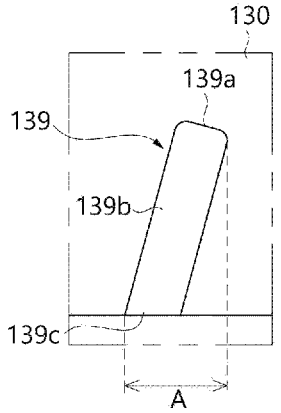
FIG. 11B is a front view illustrating a brush protrusion extending in an inclining direction relative to the raising/lowering direction of the cleaning unit provided in the cleaning ring, consistent with the disclosed embodiments.
Figure 11C:
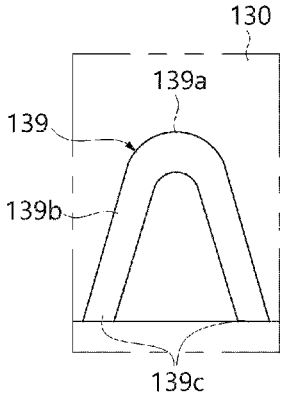
FIG. 11C is a front view illustrating a brush protrusion with a V shape provided in the cleaning ring, consistent with the disclosed embodiments.

FIGS. 11A, 11B, and 11C illustrate different examples of brush protrusion 139, and are front views of cleaning ring 130. First, in some embodiments, as illustrated in FIG. 11A, brush protrusion 139 may extend in a vertical direction on the surface of cleaning ring 130. That is, brush protrusion 139 may be formed in the same direction as the raising/lowering direction of cleaning unit 110.

Alternatively, as illustrated in FIG. 11B, brush protrusion 139 may extend in an inclining direction relative to the raising/lowering direction of cleaning unit 110. In this case, the entire side-to-side width A of brush protrusion 139 may be larger than the side-to-side width of brush protrusion 139 of the earlier example. Accordingly, the probability that foreign matter may be held in brush protrusion 139 and be moved with brush protrusion 139 during the raising/lowering of cleaning unit 110 may be further increased.

Alternatively, as illustrated in FIG. 11C, brush protrusion 139 may have a V shape or an inverted shape thereof. Due to such a shape, brush protrusion 139 may more securely hold foreign matter such that the foreign matter is moved together with brush protrusion 139.

Figure 13A:
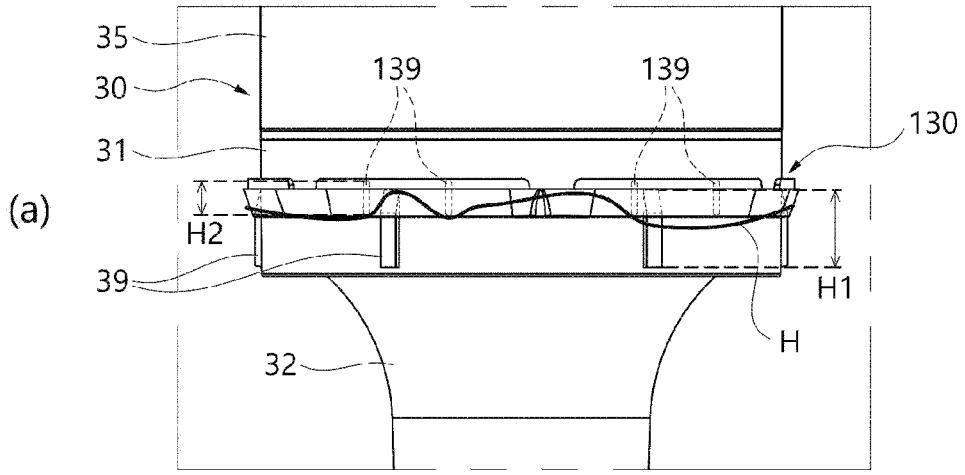
FIG. 13A is an operation state view illustrating a state prior to the complete lowering of the cleaning unit, consistent with the disclosed embodiments.

When thin and long foreign matter such as hair H is wound on the surface of filtering unit 30, such brush protrusion 139 may function to pull down the foreign matter. After the foreign matter is pulled down, the foreign matter may be induced to be held in holding ribs 39. This may be naturally performed because brush protrusions 139 and holding ribs 39 are alternately arranged when brush protrusions 139 and holding ribs 39 are located at the same height as illustrated in FIGS. 13A and 13B.

Figure 13B:
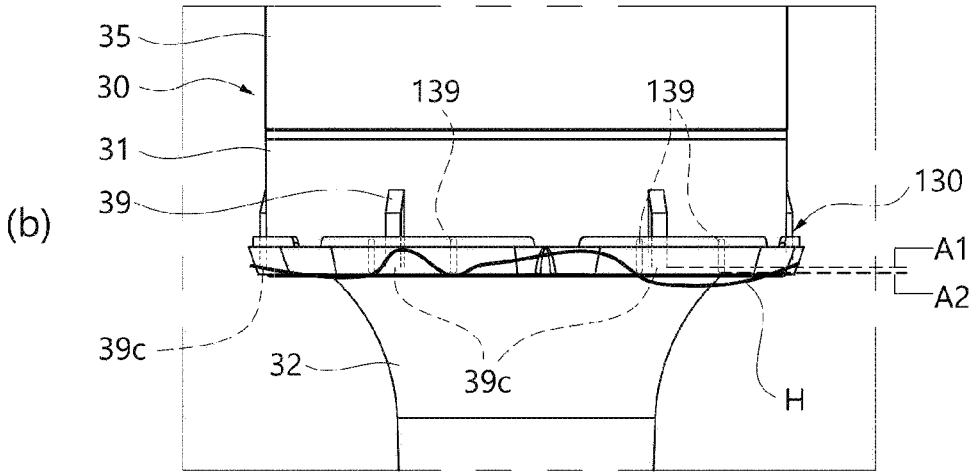
FIG. 13B is an operation state view illustrating foreign matter being held securely in the lower end of the holding ribs, consistent with the disclosed embodiments.

Particularly, as illustrated in FIG. 13B, in some embodiments, when cleaning unit 110 is located at the second position at which cleaning unit 110 is completely lowered, lower end A2 of brush protrusion 139 may be located at a position lower than lower end A1 of holding rib 39 such that lower end A2 of brush protrusion 139 is closer to the bottom of dust collection space S1 than lower end A1 of holding rib 39. Accordingly, foreign matter pulled by lower inclining surface 139*c* of brush protrusion 139 may be held in holding step surface 39*c* of holding rib 39 and may be collected at the lower side of filtering unit 30.

Particularly, as described above, holding step surface 39*c* may form the step in cooperation with the surface of filtering unit 30, and thus foreign matter may be more easily held in holding step surface 39*c*. When the foreign matter is held in holding step surface 39*c*, cleaning unit 110 is raised to the first position, i.e. the initial position. In this case, the foreign matter may not be allowed to be moved with cleaning unit 110 and may be collected at the lower side of holding step surface 39*c*.

Meanwhile, reinforcement plate 140 (see FIG. 2) may be coupled to cleaning body 120. The force of raising and lowering cleaning unit 110 may be focused on a connection bracket 149 connected to manipulation unit 150. The protruding length of cleaning unit 110 toward introduction opening 8 relative to connection bracket 149 may be long, and thus a large load may be inevitably focused on connection bracket 149. Accordingly, connection portion 128 (i.e., connecting plate 128 (see FIG. 9)) may be easily twisted. When connecting plate 128 is twisted, cleaning unit 110 may be eccentric as a whole, so the efficient raising/lowering of cleaning unit 110 may not be performed. FIGS. 5A and 5B illustrate the protruding state of assembly part 145 of reinforcement plate 140 to be assembled with cleaning unit 110.

As illustrated in FIG. 2, connection bracket 149 may be provided at a side of reinforcement plate 140. Connection bracket 149 may protrude from the lower portion of reinforcement plate 140 in the direction of inner surface 20 of housing 1. Connection bracket 149 may be connected to the lower end of movable rail 175 of manipulation unit 150 so that movable rail 175 and reinforcement plate 140 raise and lower together.

Such reinforcement plate 140 may be made of various materials. For example, reinforcement plate 140 may be made of synthetic resin or metal. In some embodiments, reinforcement plate 140 may be made of aluminum, and cleaning body 120 may be made of synthetic resin.

Next, referring to FIGS. 12A, 12B, 12C, 13A, and 13B, the process of moving foreign matter to the lower part of dust collection space S1 by using cleaning unit 110 will be described. When a user presses down button part 165 of manipulation lever 160, cleaning unit 110 may compress dust contained in dust collection space S1 while being lowered into dust collection space S1. The state of cleaning unit 110 compressing the dust of the dust collection space S1 is illustrated in FIG. 4.

At the same time, cleaning unit 110 may clean the surface of filtering unit 30 while being lowered by scraping the surface thereof. That is, cleaning unit 110 may remove foreign matter on the surface of filtering unit 30. For example, cleaning unit 110 may scrape off dust on mesh net 35. Furthermore, cleaning unit 110 may scrape off thin foreign matter such as hair H wound around mesh net 35. This is performed by brush protrusions 139. Like a comb, multiple brush protrusions 139 may scrape down foreign matter, so tangled or wound foreign matter may also be moved down with brush protrusions 139.

Figure 12A:
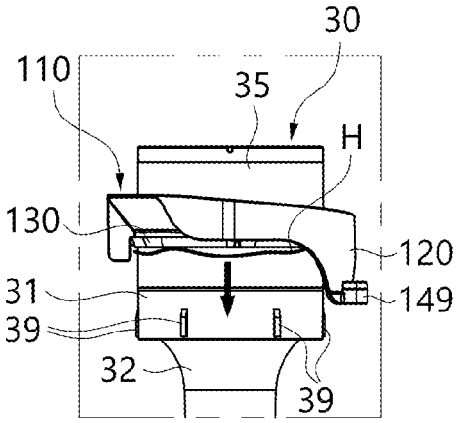
FIG. 12A is an operation state view illustrating foreign matter being moved downward with the brush protrusions, consistent with the disclosed embodiments.
Figure 12B:
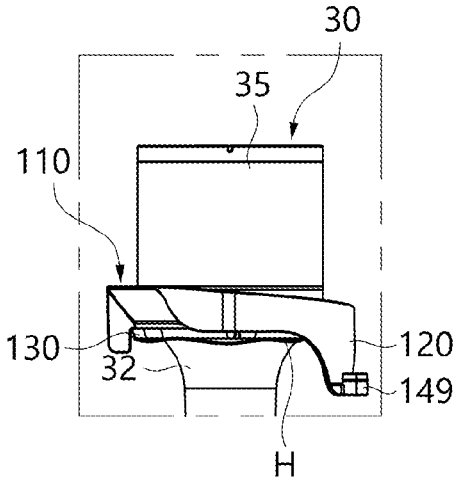
FIG. 12B is an operation state view illustrating foreign matter being held by the holding ribs when the cleaning unit is completely lowered, consistent with the disclosed embodiments.
Figure 12C:
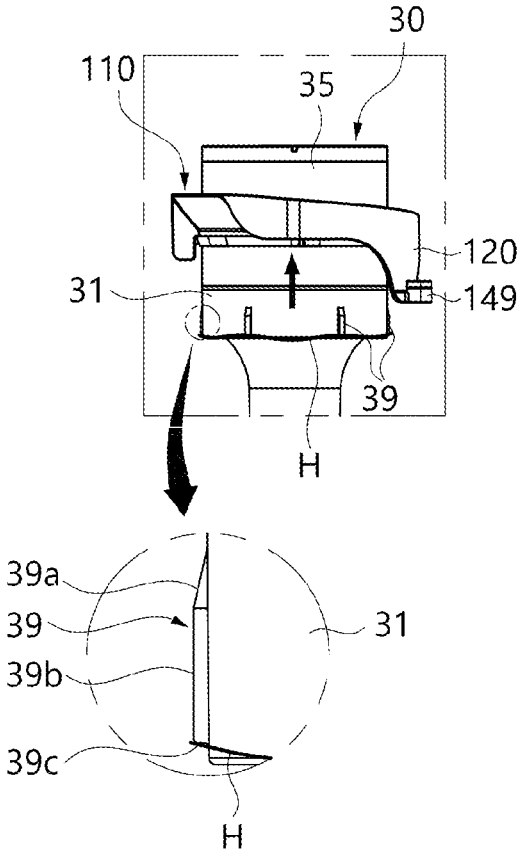
FIG. 12C is an operation state view illustrating foreign matter remaining in the lower side of the holding ribs as the cleaning unit is raised to the initial position, consistent with the disclosed embodiments.

As illustrated in FIG. 12A, when foreign matter is held in the lower end of cleaning unit 110, the foreign matter may be moved downward with brush protrusions 139. That is, the foreign matter may not escape to the gap between cleaning unit 110 and filtering unit 30, and are taken down with brush protrusions 139 by being held therein. As illustrated in FIG. 12B, when cleaning unit 110 is completely lowered, the foreign matter may be held in holding ribs 39. Finally, as illustrated in FIG. 12C, although cleaning unit 110 is raised to the first position, the foreign matter may be collected at the lower side of holding ribs 39.

More precisely, FIG. 13A illustrates a state prior to the complete lowering of cleaning unit 110, and illustrates the state of foreign matter held in lower inclining surface 139*c* of each of brush protrusions 139. In this state, when cleaning unit 110 is completely lowered, lower end A2 of brush protrusion 139 is moved to a position lower than lower end A1 of holding rib 39, and the foreign matter may be securely held in lower end A1 of holding rib 39 as illustrated in FIG. 13B.

Figure 14:
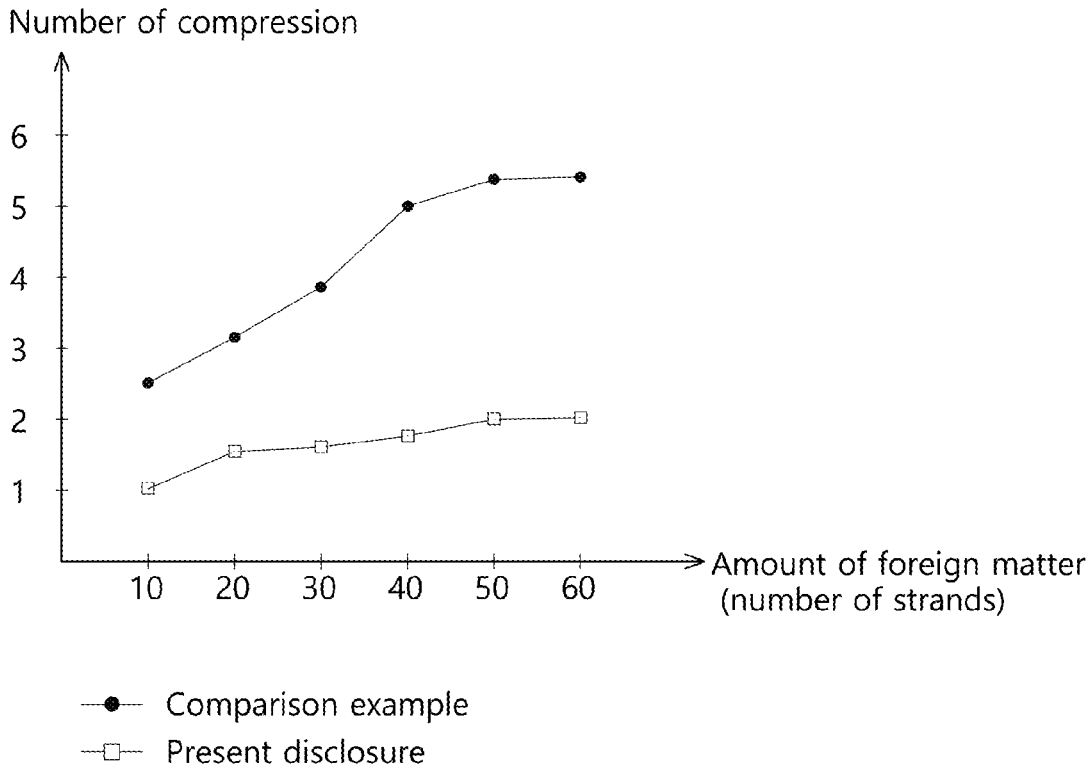
FIG. 14 is a graph illustrating the result of comparing a test example in which foreign matter is removed by using the cleaning unit of the present disclosure with a comparison example, consistent with the disclosed embodiments.

FIG. 14 illustrates the test result of whether hair H is removed to the lower side of filtering unit 30 by operating cleaning unit 110 after introducing hair H by using the cleaner of the present disclosure. The horizontal axis of a graph represents the number of strands of hair H which is foreign matter, and the vertical axis thereof represents the number of reciprocating movements of cleaning unit 110. In addition, the average value of the number of the reciprocating movements of cleaning unit 110 to completely remove hair H toward the lower side of filtering unit 30 is illustrated in the graph.

As illustrated in the graph, if cleaning unit 110 is reciprocated only up to two times when the number of the strands of hair H is increased from 10 to 60, the hair H can be seen to be completely removed to the lower side of filtering unit 30, that is, the lower part of dust collection space S1. On the other hand, in the comparison example in which brush protrusions 139 and holding ribs 39 are not provided, as the number of strands of hair H increases, the number of reciprocating movements of cleaning unit 110 can be seen to increase, and when cleaning unit 110 is reciprocated up to six times, the hair H can be completely removed.

According to some embodiments, although thin and long foreign matter such as hair H is wound on the outer surface of filtering unit 30, the foreign matter may not be allowed to escape to the gap between cleaning unit 110 and filtering unit 30 and may be reliably removed toward the bottom of dust collection space S1 by cleaning unit 110.

As described above, just because all the components constituting the cleaner according to the embodiments of the present disclosure have been described as being combined into one or operating in the combination, the present disclosure is not necessarily limited to these embodiments. That is, if it is within the scope of the purpose of the present disclosure, all the components may be selectively combined into more than one and operated. In addition, terms such as "include", "constitute", or "have" described above, unless otherwise stated, mean that the corresponding component may be present. Accordingly, it should be construed that other components are not excluded, but may be included. All terms, including technical or scientific terms, have the same meaning as commonly understood by those skilled in the technical field to which the present disclosure belongs, unless defined otherwise. Commonly used terms, such as terms defined in the dictionary, should be interpreted as being consistent with the context of the relevant technology, and in the present disclosure, unless explicitly defined, should not be interpreted as having an ideal or excessively formal meaning.

What is claimed is:

1. A cleaner comprising:

a housing having an opening configured to allow air to be introduced into the housing;

a filtering unit mounted in an inner space of the housing and configured to define a dust collection space between the filtering unit and an inner surface of the housing;

a cleaning unit mounted to surround the filtering unit; and a manipulation unit comprising a manipulation housing and a manipulation lever, the manipulation unit being configured to raise and lower the cleaning unit inside the dust collection space, wherein the cleaning unit comprises a plurality of brush protrusions protruding from the cleaning unit toward a surface of the filtering unit, wherein the plurality of brush protrusions are disposed around an inner peripheral surface of a ring-shaped cleaning ring provided in the cleaning unit, wherein the plurality of brush protrusions protrude more toward the surface of the filtering unit than other portions on the inner peripheral surface of the cleaning ring, wherein at least two support ribs protrude from a lower part of the cleaning unit toward a bottom of the dust collection space, the support ribs being configured to support a surface of the cleaning ring, and wherein the at least two support ribs protrude toward the surface of the filtering unit, and a gap maintenance rib protrudes from each support rib in an opposite direction of a guide inclination surface of the cleaning ring, wherein the plurality of brush protrusions are arranged between adjacent gap maintenance ribs.

2. The cleaner of claim 1, wherein the cleaning unit comprises:

a cleaning body surrounding the filtering unit and connected to the manipulation unit, the cleaning body having a guide flow path configured to guide the air introduced via the opening; and the cleaning ring disposed on a lower part of the cleaning body, the cleaning ring extending toward the bottom of the dust collection space and including the plurality of brush protrusions protruding from a surface of the cleaning ring, the cleaning ring being configured to clean the surface of the filtering unit when the cleaning unit is raised or lowered by the manipulation unit.

3. The cleaner of claim 1, wherein the plurality of brush protrusions are formed on the cleaning ring of the cleaning unit, the cleaning ring being made of an elastic material.

4. The cleaner of claim 1, wherein each of the plurality of brush protrusions extends in a direction parallel to an axis along which the cleaning unit is raised or lowered.

5. The cleaner of claim 1, wherein each of the plurality of brush protrusions is inclined relative to an axis along which the cleaning unit is raised or lowered.

6. The cleaner of claim 1, wherein a lower end of each of the plurality of brush protrusions includes a lower inclining surface directed toward a lower part of the dust collection space, wherein an amount of protrusion of the lower inclining surface decreases in a downward direction.

7. The cleaner of claim 1, wherein an upper inclining surface is formed on an upper end of each of the plurality of brush protrusions directed toward an upper part of the dust collection space, wherein an amount of protrusion of the upper inclining surface gradually decreases in an upward direction.

8. The cleaner of claim 1, wherein a lower end of each of the plurality of brush protrusions are recessed toward an upper part of the brush protrusions.

9. The cleaner of claim 1, wherein at least one holding rib is disposed on the surface of the filtering unit, the at least one holding rib protruding toward an inner surface of the cleaning unit facing the surface of the filtering unit.

10. The cleaner of claim 9, wherein the cleaning unit is configured to move between a first position in which the cleaning unit is raised and a second position in which the cleaning unit is lowered, and the at least one holding rib is disposed on a lower part of the filtering unit such that at least a portion of the at least one holding rib has a section overlapping with the cleaning unit, when the cleaning unit is located at the second position.

11. The cleaner of claim 9, wherein the at least one holding rib includes a plurality of holding ribs surrounding the surface of the filtering unit, and arranged such that the plurality of brush protrusions pass between adjacent pairs of holding ribs when the cleaning unit is raised or lowered.

12. The cleaner of claim 9, wherein when the cleaning unit is located at a second position at which the cleaning unit is completely lowered, a lower end of each of the plurality of brush protrusions are located at a position lower than a lower end of the at least one holding rib such that the lower end of the plurality of brush protrusions are nearer to the bottom of the dust collection space than the lower end of the at least one holding rib.

13. The cleaner of claim 9, wherein an upper end of the at least one holding rib includes a guide inclination surface inclined in a downward direction.

14. The cleaner of claim 13, wherein a lower end of the at least one holding rib includes a holding step surface, the holding step surface having an inclination steeper than an inclination of the guide inclination surface.

15. The cleaner of claim 9, wherein a length of the at least one holding rib is greater than lengths of the plurality of brush protrusions.

16. A cleaner comprising:

a housing having an opening configured to introduce air into the housing;

a first cyclone part mounted to the housing and configured to separate dust from the air introduced through the opening;

a second cyclone part mounted in an inner space of the housing and configured to define a dust collection space between the second cyclone part and an inner surface of the housing;

a cleaning unit mounted to surround the second cyclone part and configured to be raised and lowered inside the dust collection space, with a plurality of brush protrusions protruding from an inner surface of the cleaning unit facing a surface of the second cyclone part; and a manipulation unit comprising a manipulation housing and a manipulation lever, the manipulation unit being configured to raise or lower the cleaning unit, the manipulation unit being connected to the cleaning unit, wherein at least a portion of the manipulation lever protrudes outside the housing, wherein the plurality of brush protrusions are disposed around an inner peripheral surface of a ring-shaped cleaning ring provided in the cleaning unit, wherein the plurality of brush protrusions protrude more toward the surface of the second cyclone part than other portions on the inner peripheral surface of the cleaning ring, wherein at least two support ribs protrude from a lower part of the cleaning unit toward a bottom of the dust collection space, the support ribs being configured to support a surface of the cleaning ring, and wherein the at least two support ribs protrude toward the surface of the second cyclone part, and a gap maintenance rib protrudes from each support rib in an opposite direction of a guide inclination surface of the cleaning ring, wherein the plurality of brush protrusions are arranged between adjacent gap maintenance ribs.

* * * * *